US010549872B2

(12) United States Patent
Yokota et al.

(10) Patent No.: US 10,549,872 B2
(45) Date of Patent: Feb. 4, 2020

(54) BOX PACKING APPARATUS

(71) Applicant: ISHIDA CO., LTD., Kyoto-shi, Kyoto (JP)

(72) Inventors: Yuji Yokota, Ritto (JP); Tatsuya Arimatsu, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 308 days.

(21) Appl. No.: 15/541,511

(22) PCT Filed: Oct. 14, 2015

(86) PCT No.: PCT/JP2015/078989
§ 371 (c)(1),
(2) Date: Jul. 5, 2017

(87) PCT Pub. No.: WO2016/117182
PCT Pub. Date: Jul. 28, 2016

(65) Prior Publication Data

US 2017/0341790 A1 Nov. 30, 2017

(30) Foreign Application Priority Data

Jan. 23, 2015 (JP) ..... 2015-011252

(51) Int. Cl.
*B65B 43/59* (2006.01)
*B65B 43/54* (2006.01)
(Continued)

(52) U.S. Cl.
CPC ..... *B65B 43/59* (2013.01); *B65B 5/106* (2013.01); *B65B 5/108* (2013.01); *B65B 35/10* (2013.01);
(Continued)

(58) Field of Classification Search
CPC .. B65B 5/06; B65B 5/08; B65B 5/106; B65B 5/108; B65B 39/00; B65B 39/007;
(Continued)

(56) References Cited

U.S. PATENT DOCUMENTS 5,515,664 A * 5/1996 Tanaka ..... B65B 5/06 53/243
5,732,536 A * 3/1998 Lin ..... B65B 5/106 53/245
(Continued)

FOREIGN PATENT DOCUMENTS

EP 1035018 A1 9/2000
JP 49-126489 A 12/1974
(Continued)

OTHER PUBLICATIONS

Extended Search Report in the corresponding European Patent Application No. 15878871.1 dated Aug. 1, 2018.
(Continued)

*Primary Examiner* — Hemant Desai
*Assistant Examiner* — Veronica Martin
(74) *Attorney, Agent, or Firm* — Global IP Counselors, LLP

(57) ABSTRACT

A box packing apparatus supports a box with a sideways facing opening while at a loading location. After loading the box is moved from the loading location. The box packing apparatus includes a supporting and moving component, arms, and a feed mechanism. The supporting and moving component supports the cardboard box in the loading location and moves the cardboard box after loading in the loading location. The arms temporarily support the cardboard box as it is delivered to the loading location with the opening thereof facing sideways, while the supporting and moving component moves the cardboard box. The feed mechanism feeds the articles into the cardboard box through the opening while the box is supported by the arms.

10 Claims, 13 Drawing Sheets

(51) Int. Cl.
*B65B 43/58* (2006.01)
*B65B 5/10* (2006.01)
*B65B 35/10* (2006.01)
*B65B 43/26* (2006.01)

(52) U.S. Cl.
CPC ..... *B65B 43/265* (2013.01); *B65B 43/54* (2013.01); *B65B 43/58* (2013.01)

(58) Field of Classification Search
CPC ..... B65B 43/54; B65B 43/56; B65B 43/58; B65B 43/59; B65B 43/265; B65B 35/10
USPC ..... 53/540, 566, 235, 244, 245, 247, 255, 53/257, 258
See application file for complete search history.

(56) References Cited

U.S. PATENT DOCUMENTS 7,096,650 B2 * 8/2006 Van Dam ..... B65B 5/061 53/201
2011/0005174 A1 * 1/2011 Prahm ..... B65B 5/061 53/473
2013/0283731 A1 10/2013 Komp
2015/0013277 A1 * 1/2015 Brandhorst ..... B65B 35/18 53/475
2015/0232217 A1 * 8/2015 Yokota ..... B65B 43/54 414/222.01
2015/0232219 A1 * 8/2015 Kern ..... B65B 35/50 53/443
2015/0298842 A1 * 10/2015 Yokota ..... B65B 43/54 53/458
2018/0244410 A1 * 8/2018 Peterman ..... B65B 35/36

FOREIGN PATENT DOCUMENTS

JP 2014-061904 A 4/2014
WO 2014-045702 A1 3/2014

OTHER PUBLICATIONS

Translation of the Written Opinion of the International Searching Authority, dated Aug. 3, 2017.

* cited by examiner

BOX PACKING APPARATUS

CROSS-REFERENCE TO RELATED APPLICATIONS

This U.S. National stage application of PCT/JP2015/078989 claims priority under 35 U.S.C. § 119(a) to Japanese Patent Application No. 2015-011252, filed in Japan on Jan. 23, 2015, the entire contents of which are hereby incorporated herein by reference.

TECHNICAL FIELD

The present invention relates to a box packing apparatus.

BACKGROUND ART

Conventionally, as shown in JP-A No. 2014-61904, a box packing apparatus equipped with a support component that supports a box being in a state in which an opening thereof faces sideways in a loading location of articles to be packed and moves the box that has been loaded with the articles to be packed from the loading location of the articles to be packed has been known.

Generally, it is required for the box packing apparatus to increase the number per-hour of boxes into which the articles to be packed are loaded and thereby improve processing efficiency.

SUMMARY OF INVENTION

Technical Problem

However, in the box packing apparatus of JP-A No. 2014-61904, when the support component moves a box that has been loaded with the articles to be packed, the support component cannot support the next box (the box into which the articles to be packed are to be loaded next) in the loading location of the articles to be packed to load the articles to be packed inside that next box. For this reason, it is difficult to achieve a sufficient improvement in the processing efficiency of the box packing apparatus.

It is a problem of the present invention to provide a box packing apparatus which is equipped with a support component that supports a box with an opening thereof facing sideways in a loading location where articles are to be packed and moves the box after being loaded with the articles from the loading location and has high processing efficiency.

Solution to Problem

A box packing apparatus pertaining to a first aspect of the present invention is a box packing apparatus that feeds and loads a plurality of the articles to be packed into each of boxes, delivered one after another to a loading location, through an opening of the box. The box packing apparatus includes a first support component, a second support component, and a feed mechanism. The first support component supports the box in the loading location of the articles to be packed in a state in which the opening thereof faces sideways and moves the box that has been loaded with the articles from the loading location. The second support component temporarily supports the box that is delivered to the loading location of the articles in a state in which the opening thereof faces sideways when the first support component moves the box that has been loaded with the articles.

The feed mechanism feeds the articles into the box being supported at least by the second support component through the opening.

In the box packing apparatus pertaining to the first aspect of the present invention, while the first support component is moving a box that has been loaded with the articles from the loading location, the next box (the box that is delivered to the loading location of the articles following the box that the first support component is moving from the loading location) is supported by the second support component in the loading location, and the articles to be packed are fed into the box being supported by the second support component. For this reason, the box packing apparatus with high processing efficiency can be realized.

A box packing apparatus pertaining to a second aspect of the present invention is the box packing apparatus pertaining to the first aspect, wherein the first support component is configured to support the box that the second support component supports in the loading location after the first support component has moved the box loaded with the articles to be packed from the loading location. The second support component moves from a support position in which the second support component supports the box to a retracted position in which the second support component does not support the box when the box that the second support component has been supported is supported by the first support component.

In the box packing apparatus pertaining to the second aspect of the present invention, when the first support component finishes moving the box that has been loaded with the articles, the first support component supports, in succession to the second support component, the box that the second support component has supported. Therefore, the number of mechanism that move the box from the loading location may be one. For that reason, it is possible to realize the box packing apparatus with high processing efficiency that can feed the articles to be packed into the next box while moving the box that has been loaded with the articles while suppressing the increment of manufacturing cost of the apparatus and increment of size of the apparatus.

A box packing apparatus pertaining to a third aspect of the present invention is the box packing apparatus pertaining to the second aspect, wherein the second support component horizontally moves between the support position and the retracted position.

In the box packing apparatus pertaining to the third aspect of the present invention, a state in which the second component supports the box and a state in which the second component does not support the box can be switched by horizontally moving the second support component. Therefore, the second support component can be realized with a relatively simple mechanism.

A box packing apparatus pertaining to a fourth aspect of the present invention is the box packing apparatus pertaining to any of the first aspect to the third aspect, wherein the second support component is configured in such a way that a height position at which the second support component supports the box is adjustable.

In the box packing apparatus pertaining to the fourth aspect of the present invention, the height position at which the second support component supports the box is adjustable, so, for example, the position of the box can be adjusted in accordance with the thickness of the articles to be packed in the height direction (in their posture at the time when they are fed by the feed mechanism) to orderly accommodate the articles to be packed inside the box.

A box packing apparatus pertaining to a fifth aspect of the present invention is the box packing apparatus pertaining to any of the first aspect to the fourth aspect, wherein the box packing apparatus stacks and loads the articles to be packed in multiple tiers inside the box being in a state in which the opening faces sideways as a result of the feed mechanism feeding the articles to be packed multiple times into the box. The feed mechanism also feeds the articles to be packed through the opening into the box being supported by the first support component. The first support component moves the box which the first support component supports in vertical direction so that the position of the box changes relative to a height at which the feed mechanism feeds the articles to be packed.

Here, in the box packing apparatus that stacks and loads the articles to be packed in multiple tiers inside the box being in a state in which the opening faces sideways, the position of the box is changed by the first support component in vertical direction relative to the feeding height of the articles to be packed. Due to this configuration, when the articles to be packed are stacked and loaded in multiple tiers, the articles to be packed can be orderly loaded inside the box, and the loading rate (the ratio of the volume that the articles to be packed occupy relative to the volume of the box) can be raised.

A box packing apparatus pertaining to a sixth aspect of the present invention is the box packing apparatus pertaining to the fifth aspect, wherein the box packing apparatus stacks and loads the articles to be packed in three or more tiers inside the box being in a state in which the opening faces sideways. The second support component supports the box until the feed mechanism finishes feeding the second tier of the articles to be packed inside the box.

In the box packing apparatus pertaining to the sixth aspect of the present invention, as the second support component supports the box until the second tier of the articles to be packed is fed into the box, it is easy to ensure a relatively long amount of time until the first support component moves the box that has been loaded with the articles to be packed and then supports the next box.

A box packing apparatus pertaining to a seventh aspect of the present invention is the box packing apparatus pertaining to the sixth aspect, wherein the box packing apparatus further includes a tabular shutter that extends in a horizontal direction. The shutter is inserted through the opening into the box, that is supported by the first support component and inside of which a part of the articles to be packed expected to be loaded have been loaded, and covers an upper side of the articles to be packed that have been loaded inside the box. The first support component moves the box upward in a state in which the shutter is inserted through the opening.

In the box packing apparatus pertaining to the seventh aspect of the present invention, the box is moved upward by the first support component in a state in which the articles inside the box are covered by the shutter. Due to this configuration, the articles can be sandwiched between the shutter and the lower surface of the box (of the box that is in a state in which the opening faces sideways) to thereby reduce gaps that arise between the articles themselves or between the articles and the box. As a result, the articles to be packed can be orderly loaded in the box to thereby raise the loading rate of the box.

A box packing apparatus pertaining to an eighth aspect of the present invention is the box packing apparatus pertaining to the seventh aspect, wherein the feed mechanism feeds the articles to be packed onto the shutter that is inserted through the opening into the box that is supported by the first support component. The articles to be packed are loaded inside the box as a result of the shutter being pulled out after the feeding of the articles to be packed.

In the box packing apparatus pertaining to the eighth aspect of the present invention, as the shutter is used when feeding the articles to be packed, the articles to be packed can be fed into the box without being hindered by the articles that have already been loaded inside the box, and the occurrence of problems such as the articles to be packed not being put into the box can be prevented.

Advantageous Effects of Invention

In the box packing apparatus pertaining to the present invention, while the first support component is moving a box that has been loaded with the articles from the loading location, the next box (the box that is delivered to the loading location of the articles to be packed following the box that the first support component is moving from the loading location of) is supported by the second support component in the loading location of the articles to be packed, and the articles to be packed are fed into the box being supported by the second support component. For this reason, the box packing apparatus with high processing efficiency can be realized.

BRIEF DESCRIPTION OF DRAWINGS

FIG. 6A depicts a state in which a cardboard box that has been loaded with articles has been placed on a conveyor belt of a box conveyance mechanism and before the next cardboard box (a cardboard box into which the articles are to be loaded next) drops from above.

FIG. 6B depicts a state in which the cardboard box that has been loaded with the articles is placed on the conveyor belt of the box conveyance mechanism and the cardboard box that has dropped from above is supported by arms.

FIG. 6C depicts a state in which the cardboard box that has been loaded with the articles is placed on the conveyor belt of the box conveyance mechanism and after the cardboard box being supported by the arms has been pushed by third guide member and moved to the loading location of the articles.

FIG. 6D depicts a state after a first tier of the articles is fed inside the cardboard box being supported by the arms.

FIG. 6E depicts a state in which the cardboard box loaded with the first tier of the articles is supported by the arms, and a holding component of a supporting and moving component is disposed, in a state in which a support surface of the holding component faces upward, under the cardboard box supported by the arms.

FIG. 6F shows a state after a second tier of the articles is fed inside the cardboard box supported by the arms.

FIG. 6G depicts a state in which the cardboard box positioned in the loading location of the articles is supported by the supporting and moving component and the arms have moved from a support position to a retracted position. Furthermore, FIG. 6G depicts a state in which a shutter is inserted into the cardboard box through the opening.

FIG. 6H depicts a state after the cardboard box is moved upward by the supporting and moving component while the shutter is inserted into the cardboard box.

FIG. 6I depicts a state in which the articles have been fed (placed) onto the shutter inserted into the cardboard box in the loading location of the articles.

FIG. 6J depicts a state in which the shutter has been pulled out from the cardboard box supported by the supporting and moving component in the loading location of the articles, and the loading of the articles into the cardboard box has completed.

FIG. 6K depicts a state after the cardboard box supported by the supporting and moving component is moved downward by the supporting and moving component (to a position at which the posture of the cardboard box is changed).

FIG. 6L depicts a state in which the holding component of the supporting and moving component has been rotated so that its support surface faces forward, and the cardboard box that has been loaded with the articles is placed on the conveyor belt of the box conveyance mechanism.

DESCRIPTION OF EMBODIMENT

Figure 1:
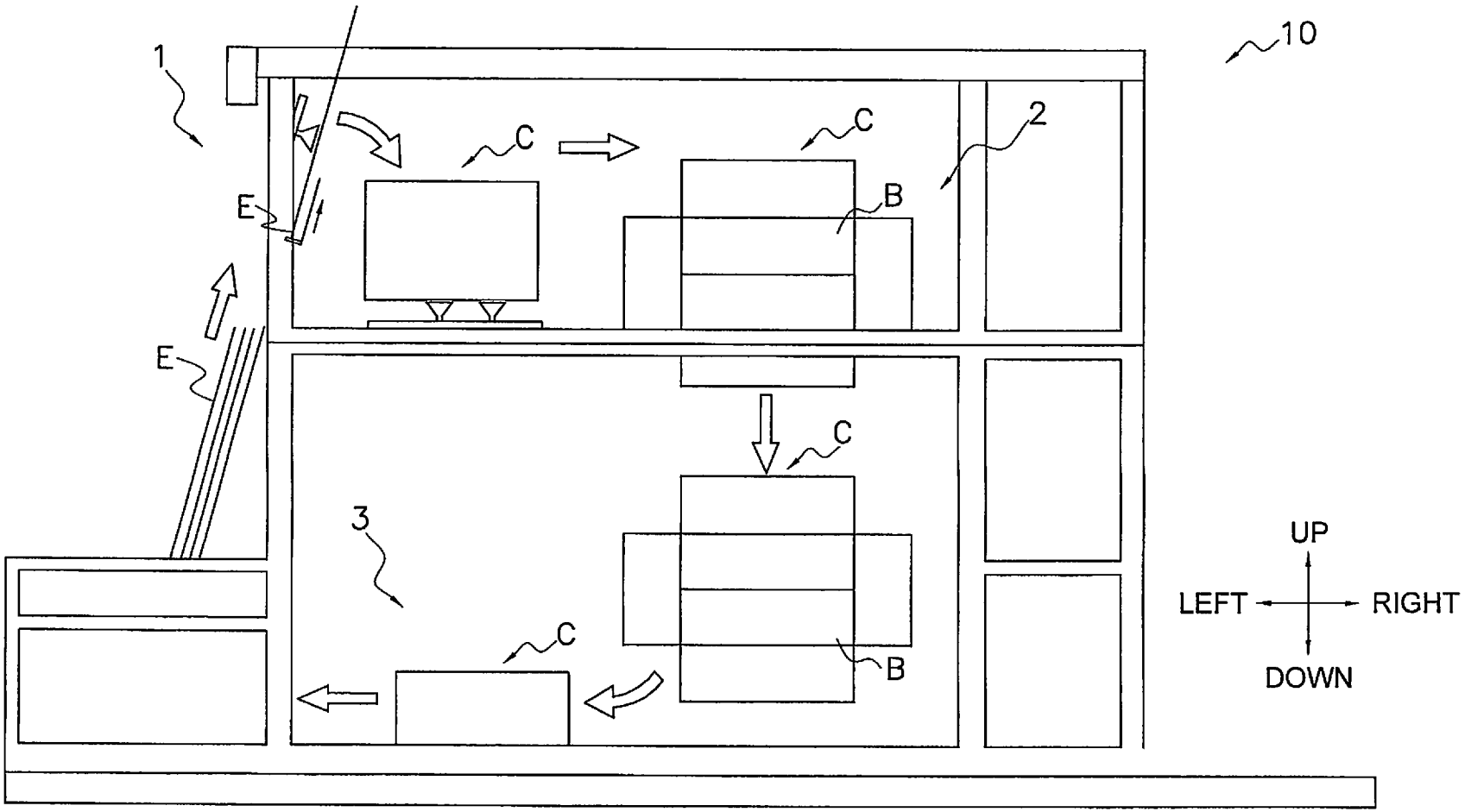
FIG. 1 is a schematic front view of a box packing apparatus pertaining to an embodiment of the present invention.

A box packing apparatus 10 pertaining to an embodiment of the present invention will be described with reference to the drawings. It will be noted that the following embodiment is a specific example of the present invention and is not intended to limit the technical scope of the present invention.

In the following description, there are cases where terms such as upper, lower, left, right, front (front surface), and rear (back surface) are used to describe directions and positions, and unless otherwise specified these will follow up, down, left, right, front, and rear indicated by arrows in the drawings. Furthermore, in the following description there are cases where expressions such as parallel, orthogonal, vertical, and horizontal are used to describe directions and positional relationships. Here, these expressions include not only cases where the directions or positional relationships are strictly parallel, orthogonal, vertical, or horizontal but also cases where the directions or positional relationships are substantially parallel, orthogonal, vertical, or horizontal.

(1) Overview

The box packing apparatus 10 will now be generally described. The box packing apparatus 10 is an apparatus that feeds and loads a plurality of the articles A, as articles to be packed, into each of cardboard boxes C, as an example of boxes, delivered one after another to a loading location L of articles A, through an opening Op of the cardboard box C. The articles A are, for example, bags having a snack food such as potato chips accommodated inside. But, the article A is not limited to this.

Figure 3:
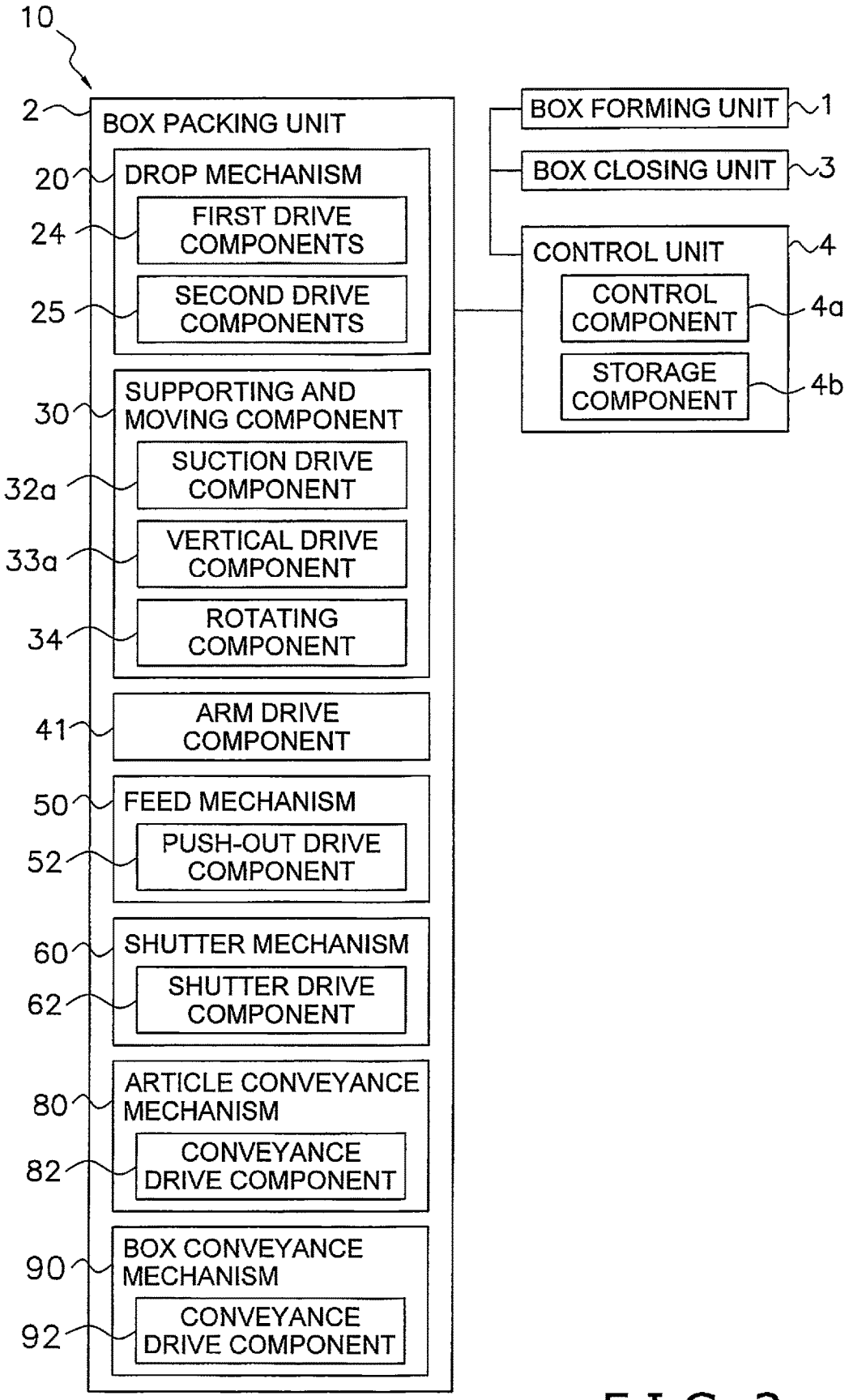
FIG. 3 is a block diagram of the box packing apparatus of FIG. 1.

The box packing apparatus 10 mainly includes a box forming unit 1, a box packing unit 2, a box closing unit 3, and a control unit 4 (see FIG. 1 and FIG. 3).

The box forming unit 1 opens (unfolds) a cardboard sheet E (a cardboard box C in a folded-up state), and closes and tapes a bottom B of the cardboard box C to thereby form a cardboard box C having only one side (only the top side) open (see FIG. 1). The cardboard box C that has been formed by the box forming unit 1 is conveyed by a non-illustrated conveyor to the box packing unit 2 (see FIG. 1). The box forming unit 1 delivers the formed cardboard boxes C one after another to the box packing unit 2.

The cardboard box C that is in a state in which the opening Op (see FIG. 6B) faces sideways is supplied by the non-illustrated conveyor of the box forming unit 1 to the box packing unit 2. More specifically, the cardboard box C whose bottom B is disposed on the front surface side of the box packing apparatus 10 and whose opening Op is disposed on the back surface side—that is to say, the cardboard box C whose opening Op faces rearward—is supplied to the box packing unit 2.

Figure 2:
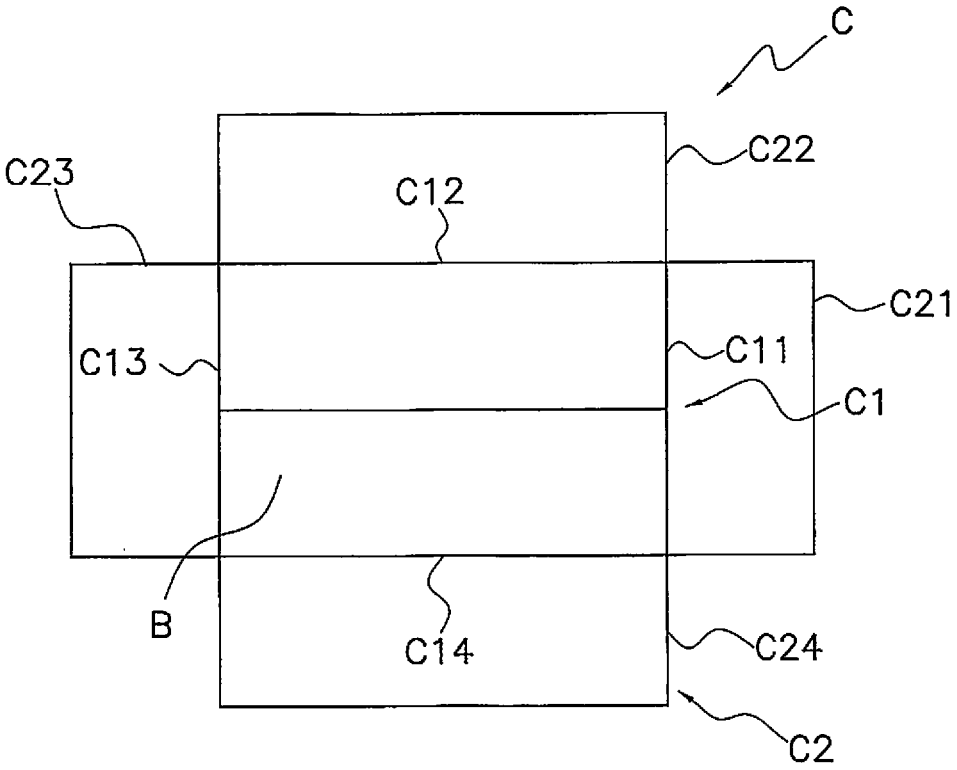
FIG. 2 is a figure of a cardboard box used to pack products in the box packing apparatus of FIG. 1 seen from a closed bottom side. Flaps on a top side (an opening side) are in an outwardly opened state.

It will be noted that as shown in FIG. 2 the cardboard box C used in the box packing apparatus 10 has a side surface portion C1, which is formed in a loop shape having four side surface portions C11 to C14, and a total of eight tabular flaps C2, which extend forward and backward from the four side surface portions C11 to C14.

At the point in time when the cardboard box C is supplied to the box packing unit 2, the flaps C2 on the front surface side of the box packing apparatus 10 have been closed by the box forming unit 1 so that the bottom B is formed as shown in FIG. 1. In contrast, when the cardboard box C is supplied to the box packing unit 2, flaps C21 to C24 (C2) on the back surface side of the box packing apparatus 10 are in an outwardly open state. In other words, when the cardboard box C is supplied to the box packing unit 2, the box packing apparatus 10 is in a state in which the opening Op faces rearward. The cardboard box C is supplied to the box packing unit 2 in a state in which the side surface portion C14 faces downward as shown in FIG. 2.

Figure 6A:
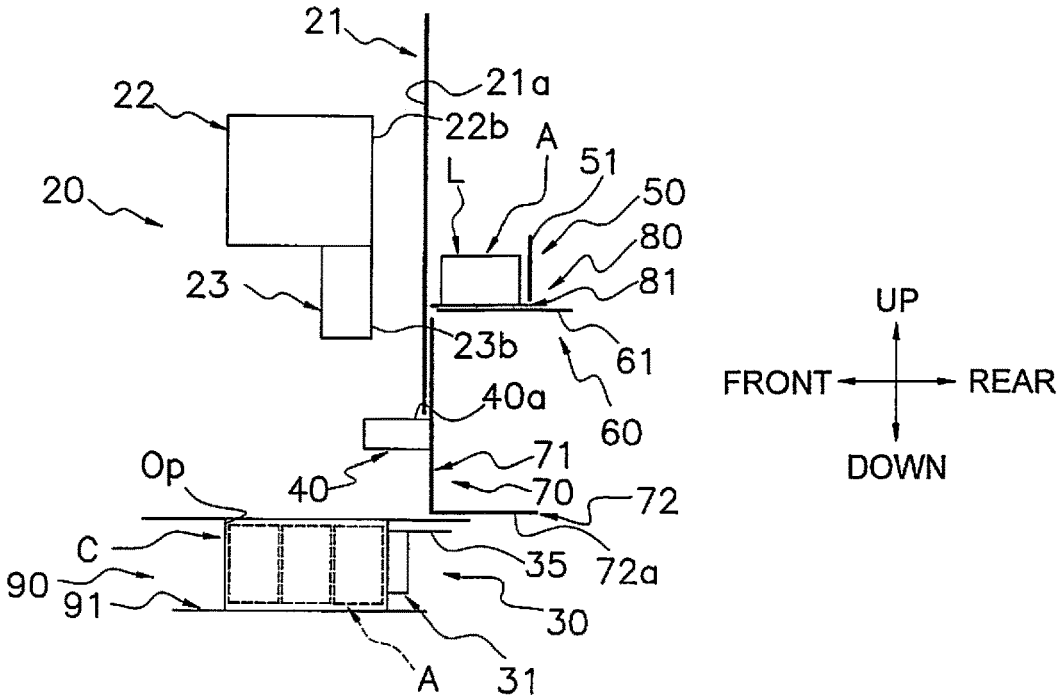
FIG. 6A is a figure depicting the operation of a box packing unit of the box packing apparatus of FIG. 1.

The box packing unit 2 mainly has a drop mechanism 20, a supporting and moving component 30, arms 40, a feed mechanism 50, a shutter mechanism 60, a spill-out prevention mechanism 70, an article conveyance mechanism 80, and a box conveyance mechanism 90 (see FIG. 6A).

The drop mechanism 20 downwardly drops the cardboard box C that is supplied one after another from the box forming unit 1, whose side surface portions C14 faces downward and whose opening Op faces rearward. The cardboard box C dropped by the drop mechanism 20 drops onto the arms 40. The cardboard box C that has dropped onto the arms 40 is moved by third guide members 23 of the drop mechanism 20 described later to the loading location L of the articles A. The arms 40 temporarily support the cardboard box C until the cardboard box C is supported by the supporting and moving component 30.

The supporting and moving component 30 supports the cardboard box C in the loading location L of the articles A. Furthermore, the supporting and moving component 30 moves the cardboard box C that has been loaded with the articles A from the loading location L of the articles A onto a conveyor belt 91 of the box conveyance mechanism 90 described later.

The feed mechanism 50 feeds the articles A that are conveyed by the article conveyance mechanism 80 into each of the cardboard boxes C being supported by the supporting and moving component 30 or the arms 40 through the opening Op of the cardboard box C.

The spill-out prevention mechanism 70 prevents the articles A that have been loaded into the cardboard box C from spilling out of the cardboard box C that is in a state in which the opening Op faces sideways.

The box conveyance mechanism 90 conveys the cardboard box C that has been placed thereon by the supporting and moving component 30 and is in a state in which the opening Op face upward in a horizontal direction and supplies it to the box closing unit 3.

The box closing unit 3 forms a top by closing the flaps C2 (the flaps C21 to C24) of the cardboard box C that has been supplied thereto from the box conveyance mechanism 90 and whose opening Op faces upward, and tapes the tops. The cardboard box C whose top has been closed by the box closing unit 3 is conveyed out from the box packing apparatus 10.

The control unit 4 is electrically connected to the box forming unit 1, the box packing unit 2, and the box closing unit 3 as shown in FIG. 3 and controls the operations of the box forming unit 1, the box packing unit 2, and the box closing unit 3.

(2) Detailed Configuration

The box packing unit 2 and the control unit 4 will be described in detail below.

(2-1) Box Packing Unit (2-1-1) Drop Mechanism

The drop mechanism 20 drops the cardboard box C that has been supplied from the box forming unit 1 and whose opening Op faces rearward onto the arms 40 in a state in which the flaps C2 adjacent to the opening Op are outwardly opened and the side surface portion C14 faces downward. Furthermore, the drop mechanism 20 horizontally moves the cardboard box C that has dropped onto the arms 40 rearward to the loading location L of the articles A. Moreover, the drop mechanism 20 regulates the movement of the cardboard box C in the horizontal direction when the articles A are fed into the cardboard box C.

Figure 4:
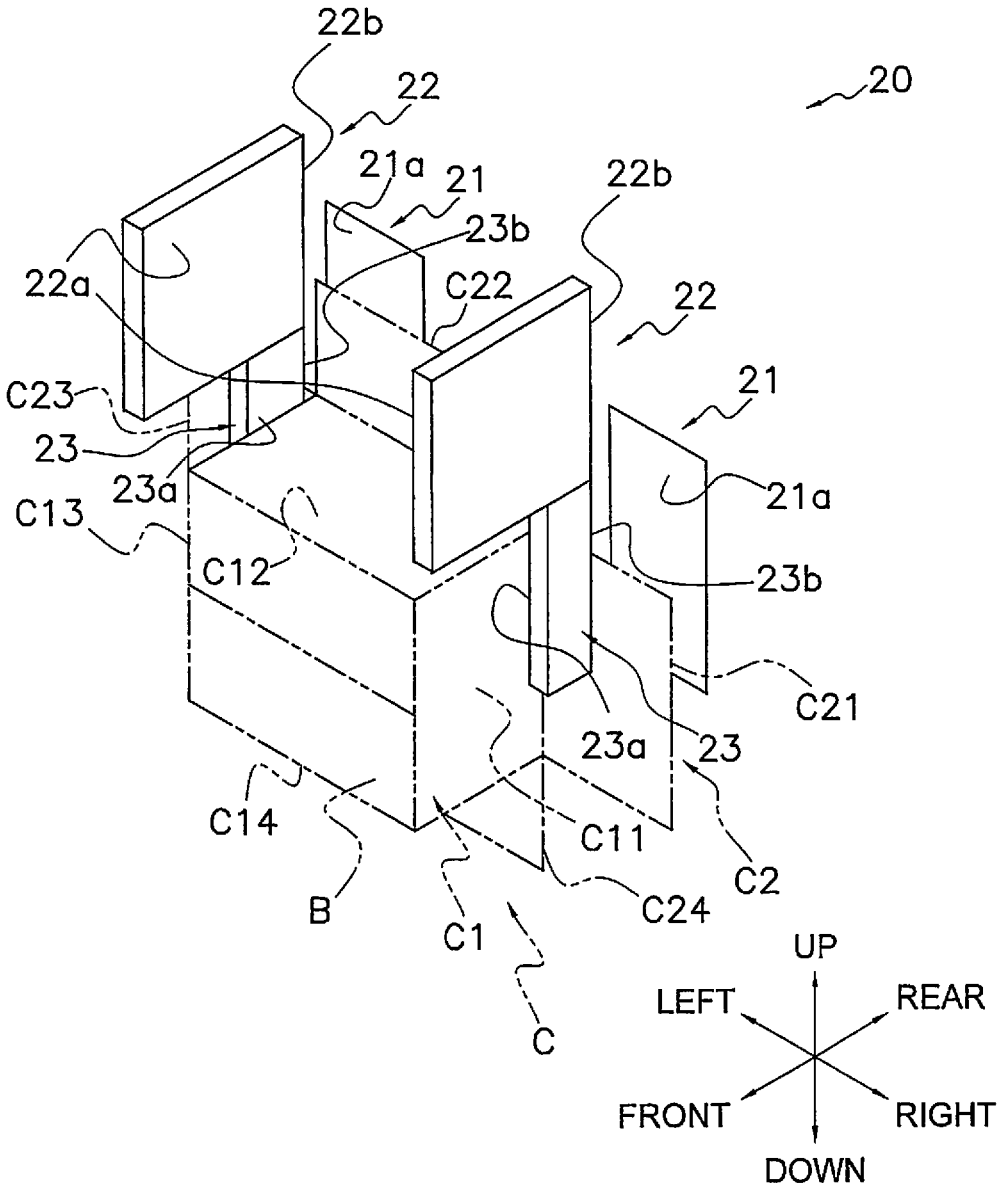
FIG. 4 is a schematic perspective view depicting a drop mechanism of the box packing apparatus of FIG. 1.

The drop mechanism 20 mainly has a pair of first guide members 21, a pair of second guide members 22, a pair of third guide members 23, first drive components 24, and second drive components 25 (see FIG. 3, FIG. 4, and FIG. 6A).

The first guide members 21 have, on their front surface sides, guide surfaces 21*a* that extend in the up and down directions and the right and left directions (see FIG. 4). When the cardboard box C is dropped, the first guide members 21 guide the outwardly opened flaps C2 of the dropping cardboard box C. In other words, when the cardboard box C is dropped, the first guide members 21 regulate the movement, in the horizontal direction, of the outwardly opened flaps C2 of the dropping cardboard box C.

One of the first guide members 21 (the first guide member 21 disposed on the left side) is disposed on the rear side of the flap C23 of the dropping cardboard box C in such a way that the guide surface 21*a* opposes the flap C23 of the dropping cardboard box C (see FIG. 4). The other of the first guide members 21 (the first guide member 21 disposed on the right side) is disposed on the rear side of the flap C21 of the dropping cardboard box C in such a way that the guide surface 21*a* opposes the flap C21 of the dropping cardboard box C (see FIG. 4). The guide surface 21*a* of the first guide member 21 that opposes the flap C21 also opposes part of the flap C22 of the dropping cardboard box C.

When the cardboard box C is dropped, the second guide members 22 guide the side surface portions C1 and the outwardly opened flaps C2 of the dropping cardboard box C. In other words, when the cardboard box C is dropped, the second guide members 22 regulate the movement, in the horizontal direction, of the side surface portions C1 and the outwardly opened flaps C2 of the dropping cardboard box C.

One of the second guide members 22 is disposed on the left side of the dropping cardboard box C. The second guide member 22 disposed on the left side of the dropping cardboard box C has on its right side a guide surface 22*a*, which opposes the side surface portion C13 of the dropping cardboard box C, and has on its back surface side a guide surface 22*b*, which opposes the flap C23 of the dropping cardboard box C (see FIG. 4). The other of the second guide members 22 is disposed on the right side of the dropping cardboard box C. The second guide member 22 disposed on the right side of the dropping cardboard box C has on its left side a guide surface 22*a*, which opposes the side surface portion C11 of the dropping cardboard box C, and has on its back surface side a guide surface 22*b*, which opposes the flap C21 of the dropping cardboard box C (see FIG. 4).

The third guide members 23 are arranged below the second guide members 22 in such a way as to extend downward from the lower ends of the first guide members 21. When the cardboard box C is dropped, the third guide members 23 guide the side surface portions C1 and the outwardly opened flaps C2 of the dropping cardboard box C. In other words, when the cardboard box C is dropped, the third guide members 23 regulate the movement, in the horizontal direction, of the side surface portions C1 and the outwardly opened flaps C2 of the dropping cardboard box C.

The third guide member 23 disposed on the left side of the dropping cardboard box C has on its right side a guide surface 23*a*, which opposes the side surface portion C13 of the dropping cardboard box C, and has on its back surface side a guide surface 23*b*, which opposes the flap C23 of the dropping cardboard box C (see FIG. 4). The third guide member 23 disposed on the right side of the dropping cardboard box C has on its left side a guide surface 23*a*, which opposes the side surface portion C11 of the dropping cardboard box C, and has on its back surface side a guide surface 23*b*, which opposes the flap C21 of the dropping cardboard box C (see FIG. 4).

It will be noted that the guide surfaces 23*a* of the third guide members 23 extend continuously with the guide surfaces 22*a* of the second guide members 22 disposed above the third guide members 23. In other words, the guide surfaces 23*a* of the third guide members 23 and the guide surfaces 22*a* of the second guide members 22 disposed above the third guide members 23 are disposed in the same (hypothetical) planes. Furthermore, the guide surfaces 23*b* of the third guide members 23 extend continuously with the guide surfaces 22*b* of the second guide members 22 disposed above the third guide members 23. In other words, the guide surfaces 23*b* of the third guide members 23 and the guide surfaces 22*b* of the second guide members 22 disposed above the third guide members 23 are disposed in the same (hypothetical) planes.

The drop mechanism 20 drops the cardboard box C in such a way that the body (the section which accommodates the articles A and is surrounded by the side surface portions C1 and the bottom B) of the cardboard box C passes between the guide surfaces 22*a* of the pair of second guide members 22 and between the guide surfaces 23*a* of the pair of third guide members 23. Furthermore, the drop mechanism 20 drops the cardboard box C in such a way that the flaps C21 and C23 of the cardboard box C pass between the guide surfaces 21*a* of the first guide members 21 and the guide surfaces 22*b* of the second guide members 22 that oppose the guide surfaces 21*a* and between the guide surfaces 21*a* of the first guide members 21 and the guide surfaces 23*b* of the third guide members 23 that oppose the guide surfaces 21*a*. Because the drop mechanism 20 is configured in this way, the side surface portions C11 and C13 of the cardboard box C are guided by the guide surfaces 22*a* and the guide surfaces 23*a*, and the flaps C21 and C23 of the cardboard box C are guided by the guide surfaces 21*a*, the guide surfaces 22*b*, and the guide surfaces 23*b*. Furthermore, the flap C22 of the cardboard box C is held in an outwardly open state by the guide surfaces 21*a*. As a result, the cardboard box C drops in a predetermined posture to a predetermined position on the arms 40. Furthermore, the flaps C2 on the opening Op side (the top side) of the cardboard box C are held in an open state.

The third guide members 23 have the function of moving the cardboard box C to the loading location L of the articles A after the cardboard box C has dropped onto the arms 40. This will be specifically described.

The second guide members 22 and the third guide member 23 are configured to be driven in the forward and rearward directions by the first drive components 24. The first drive components 24 are air cylinders that drive the second guide members 22 and the third guide members 23 in the forward and rearward directions. However, the air cylinders serve as an example, and the first drive components 24 are not limited to this.

While the cardboard box C drops, the second guide members 22 and the third guide members 23 are disposed in a state in which a relatively large distance separates the guide surfaces 22*b* of the second guide members 22 and the guide surfaces 23*b* of the third guide members 23 from the guide surfaces 21*a* of the first guide members 21, so that the flaps C2 of the dropping cardboard box C are not stuck between the first guide members 21 and the second guide members 22 and between the first guide members 21 and the third guide members 23. Then, after the cardboard box C has dropped, the second guide members 22 and the third guide members 23 are moved by the first drive components 24 rearward so as to move closer to the first guide members 21. At this time, the guide surfaces 23*b* of the third guide members 23 push the surfaces on the front sides of the flaps C21 and C23 of the cardboard box C placed on the arms 40 to thereby move the cardboard box C rearward to the loading location L of the articles A adjacent to the article conveyance mechanism 80 (see FIG. 6B and FIG. 6C).

Figure 6B:
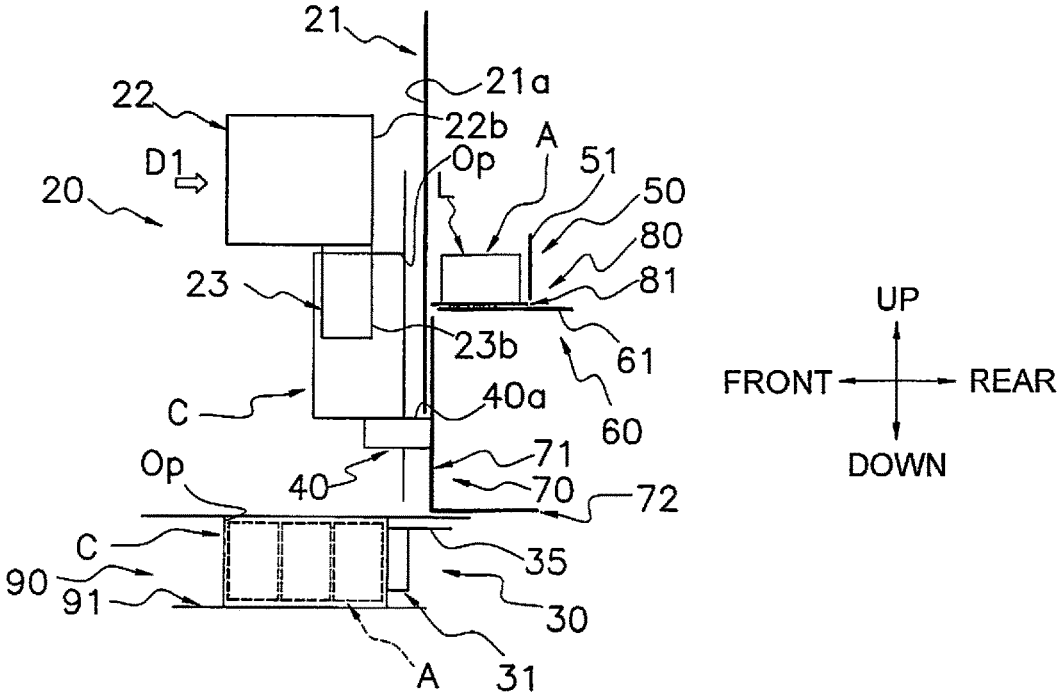
FIG. 6B is a figure depicting the operation of the box packing unit of the box packing apparatus of FIG. 1.
Figure 6C:
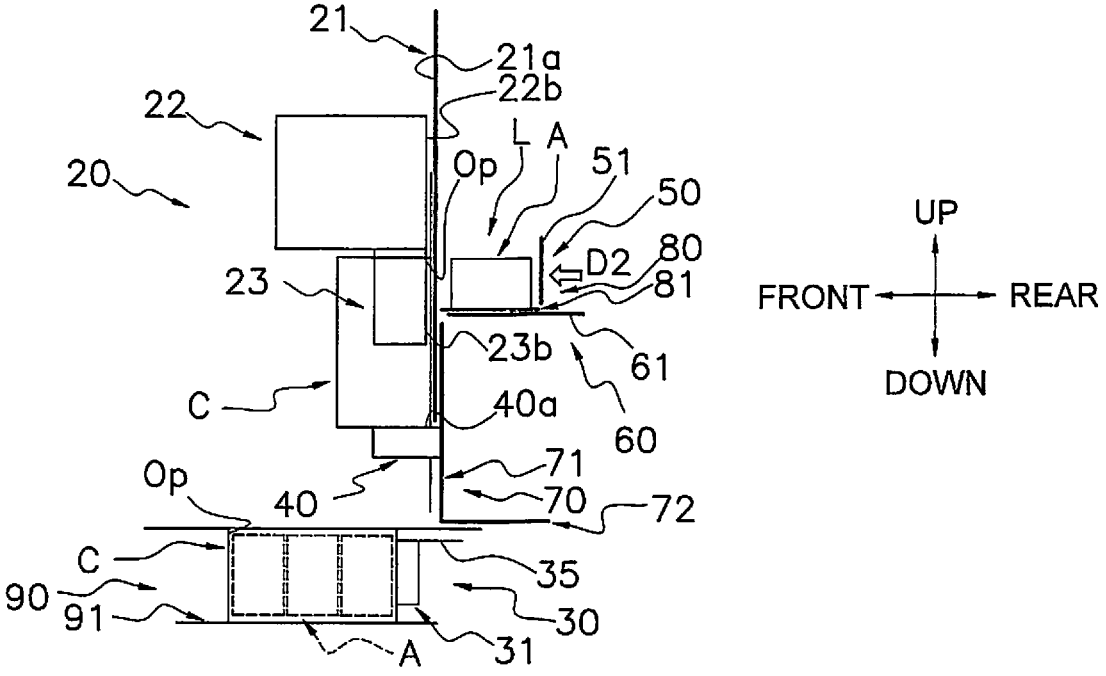
FIG. 6C is a figure depicting the operation of the box packing unit of the box packing apparatus of FIG. 1.

Then, after the third guide members 23 have moved the cardboard box C to the loading location L of the articles A, the flap C21 and the flap C23 are sandwiched between the guide surfaces 21*a* of the first guide members 21 and the guide surfaces 23*b* of the third guide members 23 until the loading of the articles A into the cardboard box C is completed (see FIG. 6C). For that reason, when the articles A are fed into the cardboard box C, movement of the flap C21 and the flap C23 in the horizontal direction (mainly in the forward and rearward directions) is regulated and the cardboard box C is prevented from moving in the horizontal direction.

It will be noted that, as described later, in the loading location L of the articles A, the cardboard box C is moved by the supporting and moving component 30 in the upward and downward directions. For that reason, the distance between the guide surfaces 21*a* of the first guide members 21 and the guide surfaces 23*b* of the third guide members 23 is set to a distance in which the cardboard box C is freely movable in the vertical direction.

It will be noted that the third guide members 23 are configured to be swingable in a clockwise direction or a counter-clockwise direction as seen from the front surface side. More specifically, the third guide members 23 are driven by the second drive components 25 and configured to be swingable in a clockwise direction or a counter-clockwise direction about rotating shafts extending in the forward and rearward direction and disposed in the neighborhoods of the lower ends of the second guide members 22. The second drive components 25 are air cylinders, for example.

The third guide members 23 are configured to be switchable between a first state and a second state as a result of being swung by the second drive components 25. In the first state, the guide surfaces 23*a* of the third guide members 23 and the guide surfaces 22*a* of the second guide members 22 are disposed in generally the same planes. In the second state, the normal direction of the guide surfaces 23*a* of the third guide members 23 and the normal direction of the guide surfaces 22*a* of the second guide members 22 intersect each other (more specifically, are orthogonal to each other). In the second state, the third guide member 23 on the left side (on the side of the side surface portion C13 of the cardboard box C) is disposed in such a way as to extend leftward from the neighborhood of the lower end of the second guide member 22 on the left side. Furthermore, in the second state, the third guide member 23 on the right side (on the side of the side surface portion C11 of the cardboard box C) is disposed in such a way as to extend rightward from the neighborhood of the lower end of the second guide member 22 on the right side.

The third guide members 23 in the first state, as mentioned above, guide the side surface portions C1 and the flaps C2 while the cardboard box C drops, push the flaps C2 and move the cardboard box C in a state in which the cardboard box C has dropped onto the arms 40, and support the cardboard box C by regulating movement of the flaps C2 of the cardboard box C in a state in which the third guide members 23 have moved the cardboard box C to the loading location L of the articles A.

In contrast, the third guide members 23 in the second state do not contact the cardboard box C and do not guide or support the side surface portions C1 and the flaps C2 of the cardboard box C.

The timing when the third guide members 23 are switched between the first state and the second state will be described later.

(2-1-2) Supporting and Moving Component

The supporting and moving component 30 is an example of a first support component. The supporting and moving component 30 supports the cardboard box C in a state in which the opening Op faces sideways in the loading location L of the articles A. The supporting and moving component 30 moves the cardboard box C in the upward and downward directions while supporting it, so that the position of the cardboard box C changes relative to the height at which the articles A are fed by the feed mechanism 50. The supporting and moving component 30 moves the cardboard box C that has been loaded with the articles A from the loading location L of the articles A onto the conveyor belt 91 of the box conveyance mechanism 90 described later.

Figure 5:
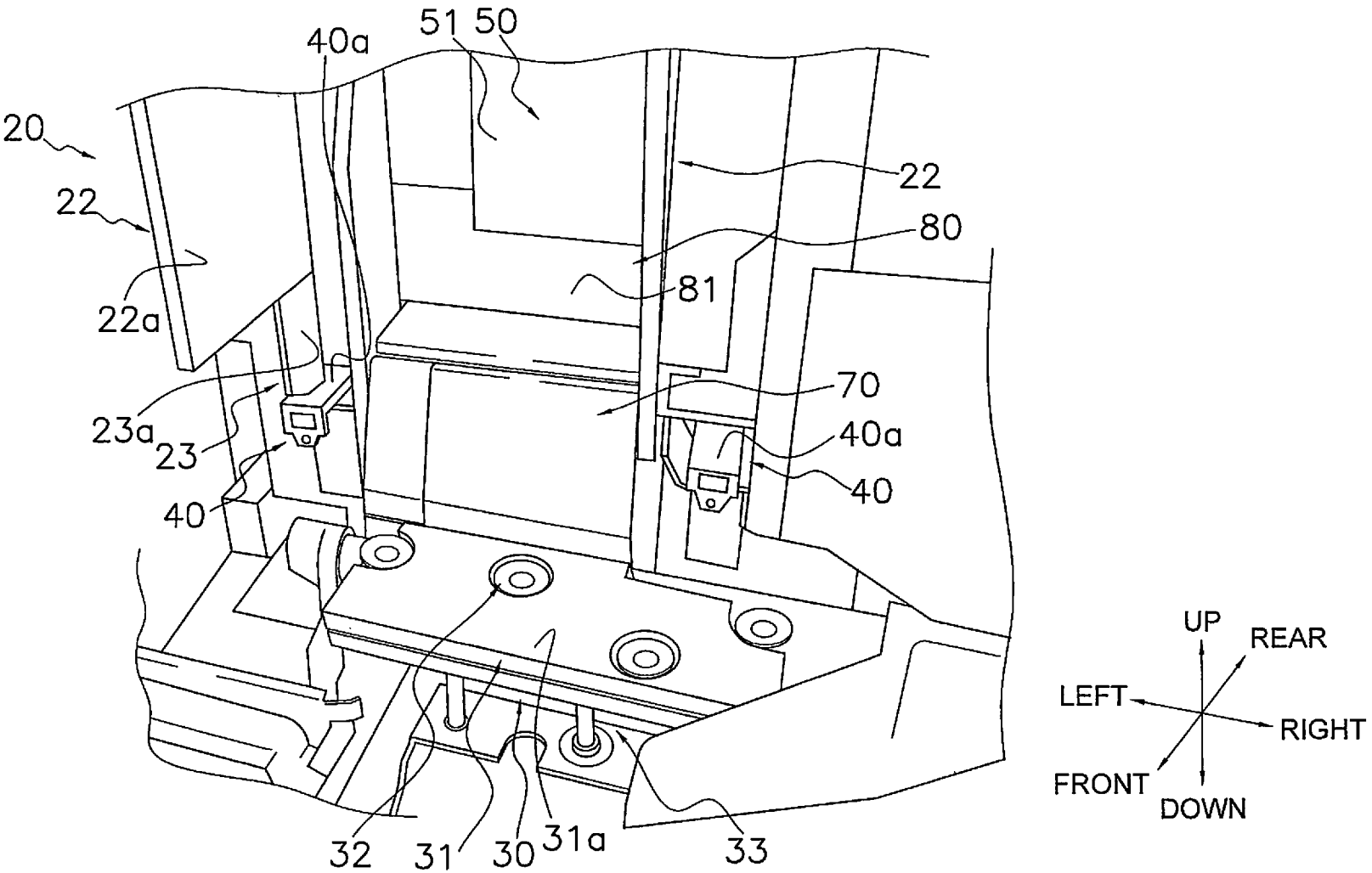
FIG. 5 is a schematic perspective view depicting a loading location of articles and its periphery in the box packing apparatus of FIG. 1.

The supporting and moving component 30, as shown in FIG. 3 and FIG. 5, mainly has a holding component 31, a vertical position adjusting component 33 that drives the holding component 31 up and down, and a rotating component 34 that rotates the holding component 31 to change the posture of the holding component 31.

The holding component 31 holds the cardboard box C by sucking onto, from below, the side surface portion C14 of the cardboard box C that is the bottom surface of the cardboard box C in the loading location L of the articles A.

The holding component 31 has a support surface 31*a* that opposes the side surface portion C14 of the cardboard box C and supports the side surface portion C14 (see FIG. 5). The holding component 31 has a push plate 35 that extends downward from the end portion on the rear side of the support surface 31*a* in a state in which the support surface 31*a* faces upward (see FIG. 6E). The push plate 35 is a member that pushes a swinging plate 72 of the spill-out prevention mechanism 70 described later and rotates the swinging plate 72. Furthermore, the holding component 31 includes suckers 32 and a suction drive component 32*a* (see FIG. 3 and FIG. 5). The suction drive component 32*a* is a vacuum pump, for example. When the suction drive component 32*a* is driven, the suckers 32 suck onto predetermined positions of the side surface portion C14 of the cardboard box C. Because the suckers 32 suck onto the side surface portion C14, the side surface portion C14 of the cardboard box C is pulled against the support surface 31*a* and the cardboard box C is held by the holding component 31.

The vertical position adjusting component 33 supports the holding component 31 from below. In other words, the vertical position adjusting component 33 supports the cardboard box C held by the holding component 31. Furthermore, the vertical position adjusting component 33 moves up and down the holding component 31 that is in a state in which the support surface 31*a* faces upward to thereby adjust the vertical position of the holding component 31. In other words, the vertical position adjusting component 33 moves up and down the cardboard box C held on the support surface 31*a* to thereby adjust the up and down position of the cardboard box C. The vertical position adjusting component 33 moves the cardboard box C in the upward and downward directions while supporting it so that the position of the cardboard box C changes relative to the height at which the articles A are fed by the feed mechanism 50. In other words, the vertical position adjusting component 33 moves the cardboard box C in the upward and downward directions while supporting it so that the position of the cardboard box C changes relative to the height of a conveyance surface of a conveyor belt 81 of the article conveyance mechanism 80 on which are placed the articles A that are pushed out by a push-out plate 51 of the feed mechanism 50 described later.

The vertical position adjusting component 33 specifically is a ball screw mechanism driven by a vertical drive component 33*a* (see FIG. 3). The vertical drive component 33*a* is a motor, for example. The vertical position adjusting component 33 is driven by the vertical drive component 33*a* to move the holding component 31 that is in a state in which the support surface 31*a* faces upward in the upward and downward directions. It will be noted that the vertical position adjusting component 33 does not need to be limited to a ball screw mechanism and that various types of configurations for supporting the holding component 31 and moving the holding component 31 up and down can be applied.

The rotating component 34 rotates the holding component 31 about a non-illustrated rotating shaft extending in the right and left direction to thereby change the posture of the holding component 31. The rotating component 34 includes a non-illustrated air cylinder, for example. The rotating component 34 drives the non-illustrated air cylinder to thereby rotate the holding component 31, that is holding the side surface portion C14 disposed in the lower portion of the cardboard box C which is in a state in which the support surface 31*a* faces upward and the opening Op faces sideways, 90 degrees about a non-illustrated rotating shaft so that the support surface 31*a* faces forward, and cause the cardboard box C to rotate to a state in which the opening Op faces upward. Furthermore, the rotating component 34 rotates the cardboard box C to thereby move the cardboard box C onto the conveyor belt 91 of the box conveyance mechanism 90.

(2-1-3) Arms

The arms 40 are an example of a second support component. The arms 40 support the cardboard box C in a state in which the opening Op faces sideways in the loading location L of the articles A (see FIG. 6C). Specifically, the arms 40 temporarily support the cardboard box C that is delivered to the loading location L of the articles A when the supporting and moving component 30 is moving the cardboard box C that has been loaded with the articles A from the loading location L of the articles A.

The arms 40 are members that have, in their upper portions, support surfaces 40*a* that extend in the forward and rearward direction and support the cardboard box C from below (see FIG. 5). The support surfaces 40*a* are horizontal surfaces. The arms 40 support particularly the flaps C2 of the cardboard box C from below with the support surfaces 40*a*.

The arms 40 are arranged on the left side and the right side respectively relative to the body (the section which accommodates the articles A and is surrounded by the side surface portions C1 and the bottom B) of the dropping cardboard box C. One of a pair of the arms 40 is disposed in the position where the flap C23 drops when the drop mechanism 20 drops the cardboard box C. The arm 40 disposed in the position where the flap C23 drops is disposed further to the left side than the second guide member 22 disposed on the flap C23 side. The other of the arms 40 is disposed in the position where the flap C21 drops when the drop mechanism 20 drops the cardboard C. The arm 40 disposed in the position where the flap C21 drops is disposed further to the right side than the second guide member 22 disposed on the flap C21 side.

It will be noted that, as described later, the articles A are fed two times by the feed mechanism 50 into the cardboard box C supported by the arms 40 (see FIG. 6F). Furthermore, as described later, at the height position at which the arms 40 support the cardboard box C, a shutter 61 is inserted through the opening Op into the cardboard box C so as to cover the upper side of two tiers' worth of the articles A accommodated in the cardboard box C (see FIG. 6G). For that reason, the height position of the arms 40 is determined in such a way that, the feed mechanism 50 can feed the articles A two times into the cardboard box C and the shutter 61 can be inserted so as to cover the upper side of the two tiers' worth of the articles A accommodated in the cardboard box C at the height position at which the arms 40 support the cardboard box C.

The arms 40 are configured to be movable by arm drive components 41 (see FIG. 3) between a support position and a retracted position. The arm drive components 41 are air cylinders, for example. The arm drive components 41 move the arms 40 horizontally o thereby move the arms 40 between the support position and the retracted position.

It will be noted that the support position of the arms 40 is a position at which, as described above, the arms 40 can catch the flap C21 or the flap C23 of the dropping cardboard box C and support the flap C21 or the flap C23 of the cardboard box C after it has dropped (see FIG. 6B and FIG. 6C). The retracted position of the arms 40 is a position at which the arms 40 cannot catch the flap C21 or the flap C23 of the dropping cardboard box C and support the flap C21 or the flap C23 of the cardboard box C after it has dropped (see FIG. 6L). In other words, the retracted position of the arms 40 is a position at which the arms 40 do not support the cardboard box C.

Figure 6D:
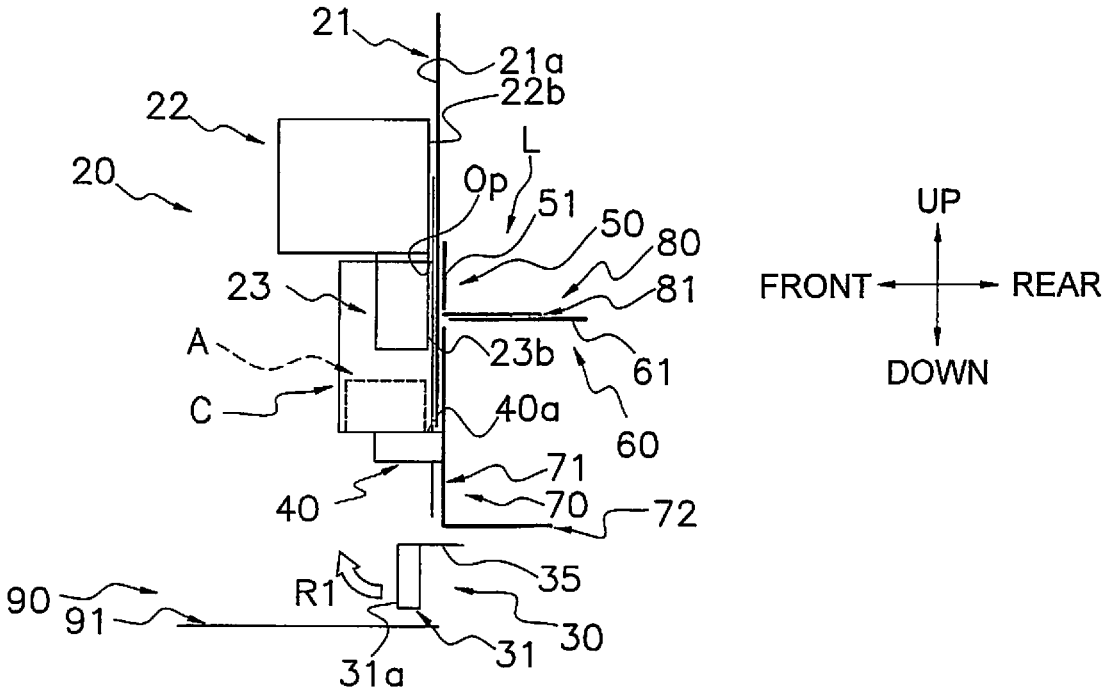
FIG. 6D is a figure depicting the operation of the box packing unit of the box packing apparatus of FIG. 1.
Figure 6E:
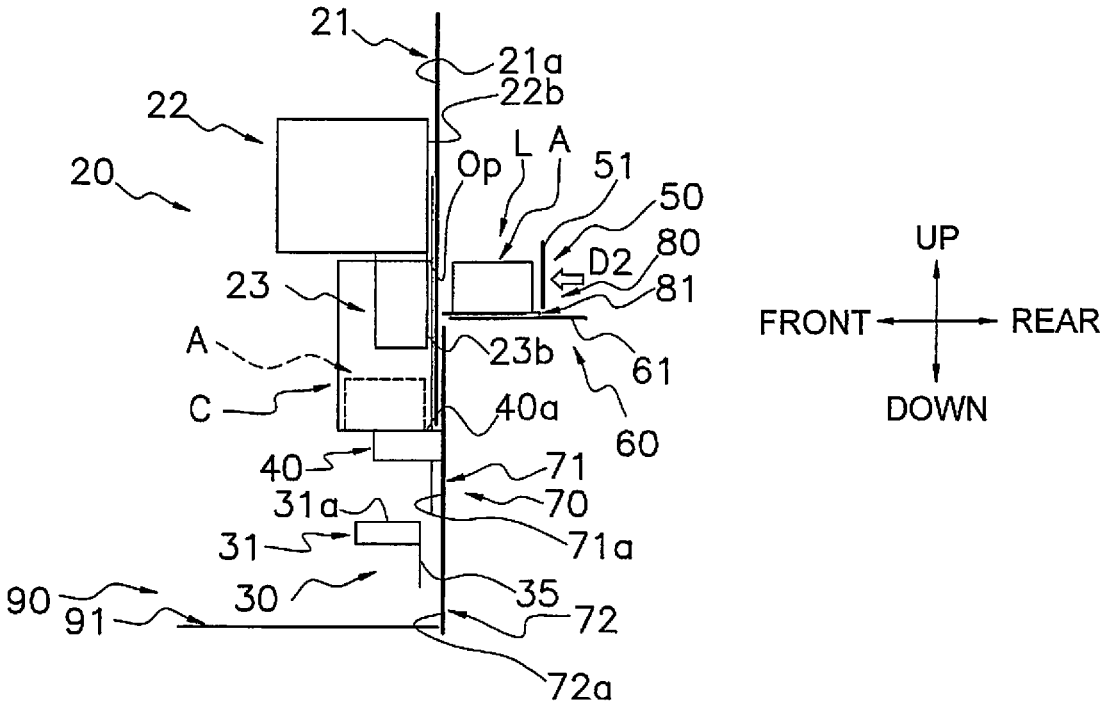
FIG. 6E is a figure depicting the operation of the box packing unit of the box packing apparatus of FIG. 1.
Figure 6F:
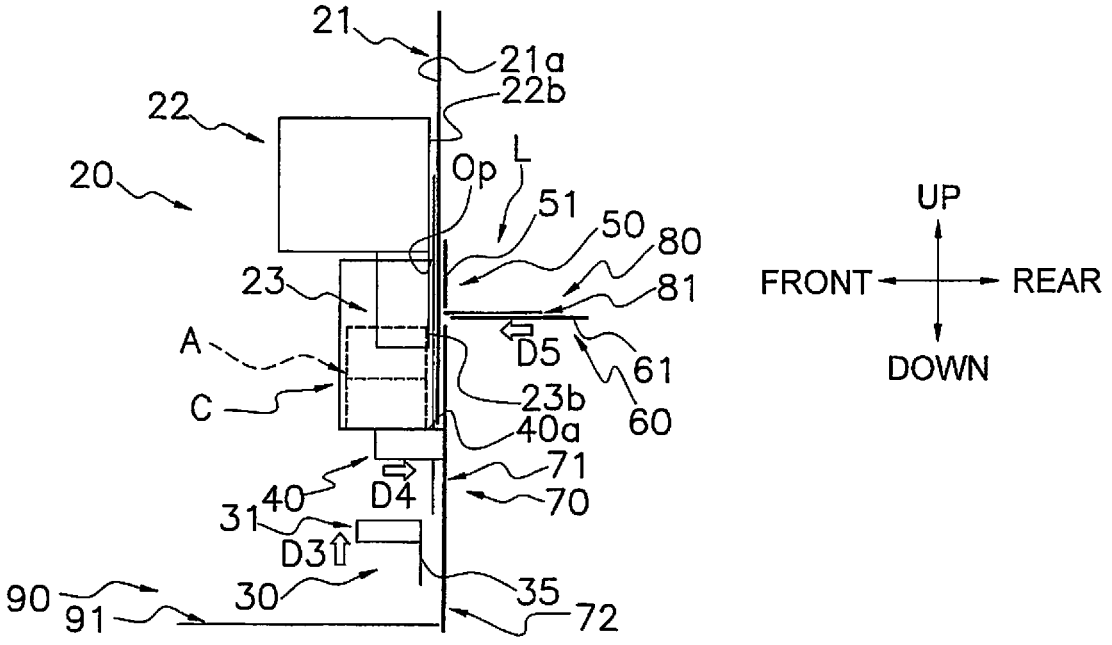
FIG. 6F is a figure depicting the operation of the box packing unit of the box packing apparatus of FIG. 1.
Figure 6G:
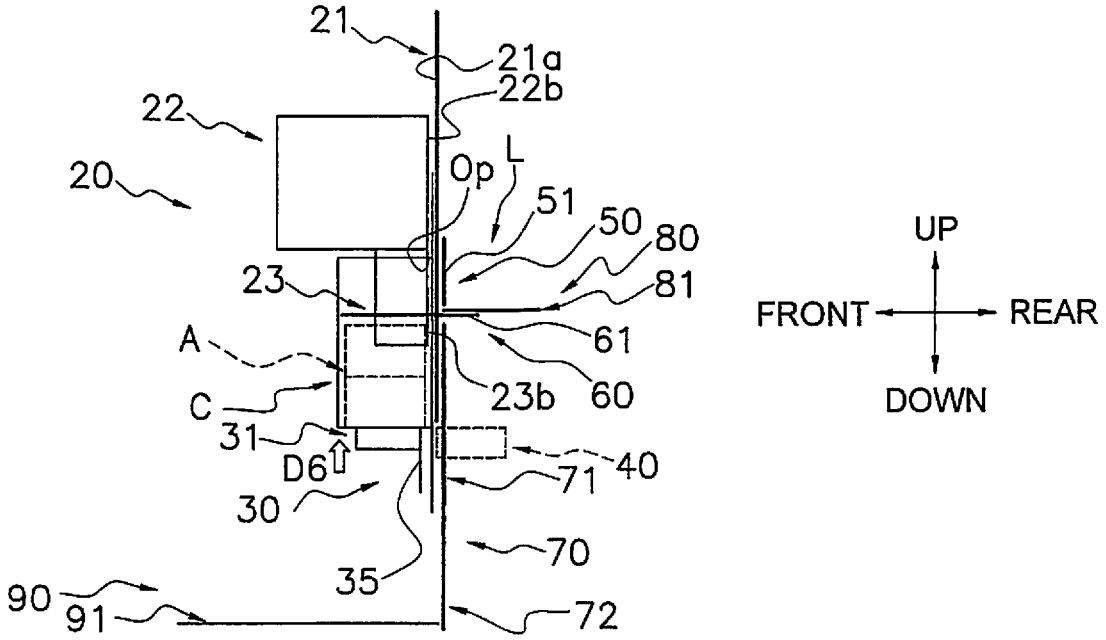
FIG. 6G is a figure depicting the operation of the box packing unit of the box packing apparatus of FIG. 1.
Figure 6H:
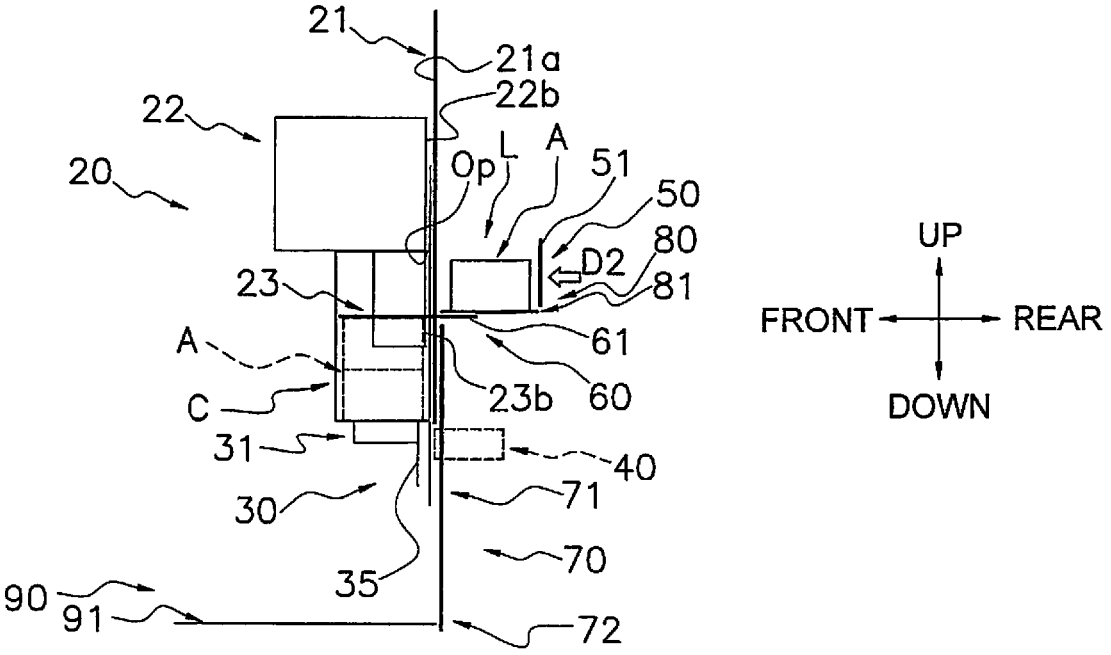
FIG. 6H is a figure depicting the operation of the box packing unit of the box packing apparatus of FIG. 1.
Figure 6I:
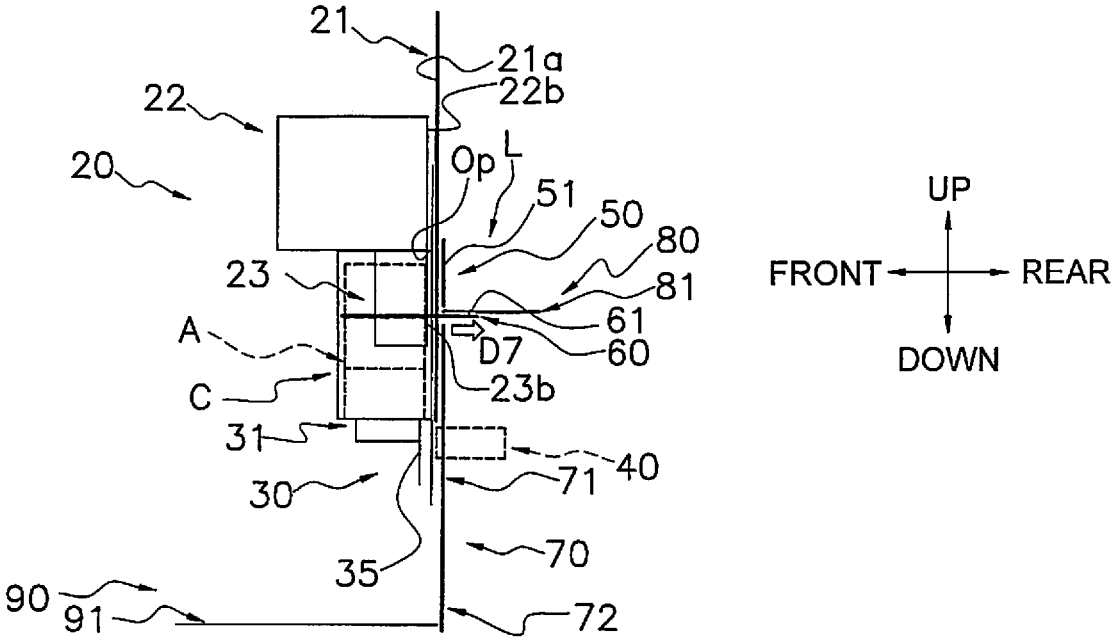
FIG. 6I is a figure depicting the operation of the box packing unit of the box packing apparatus of FIG. 1.
Figure 6J:
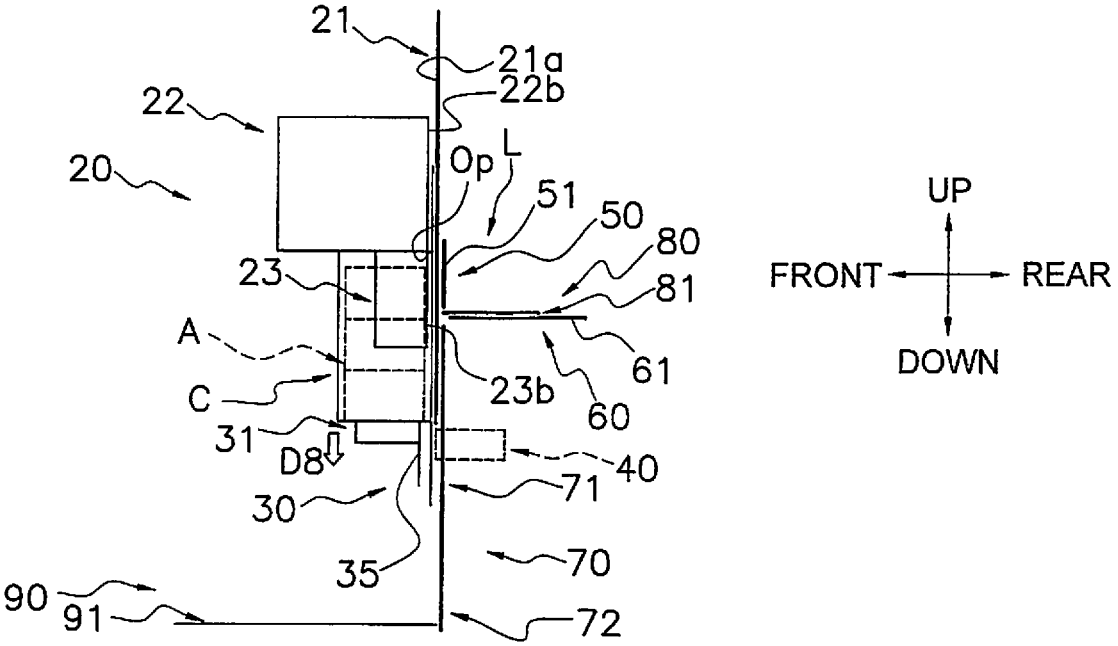
FIG. 6J is a figure depicting the operation of the box packing unit of the box packing apparatus of FIG. 1.
Figure 6K:
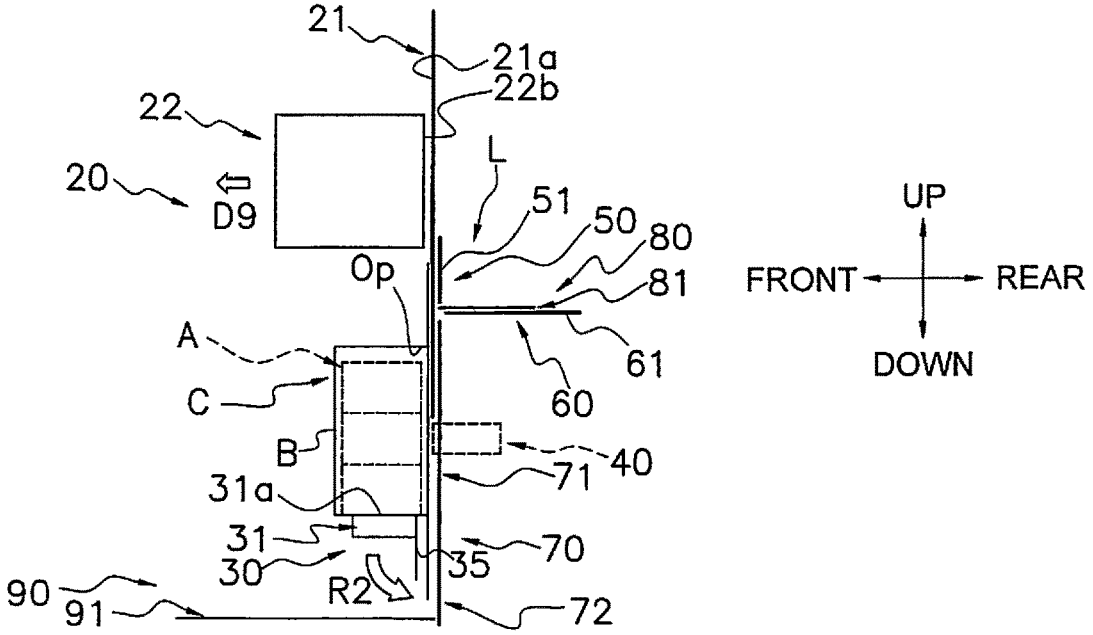
FIG. 6K is a figure depicting the operation of the box packing unit of the box packing apparatus of FIG. 1.
Figure 6L:
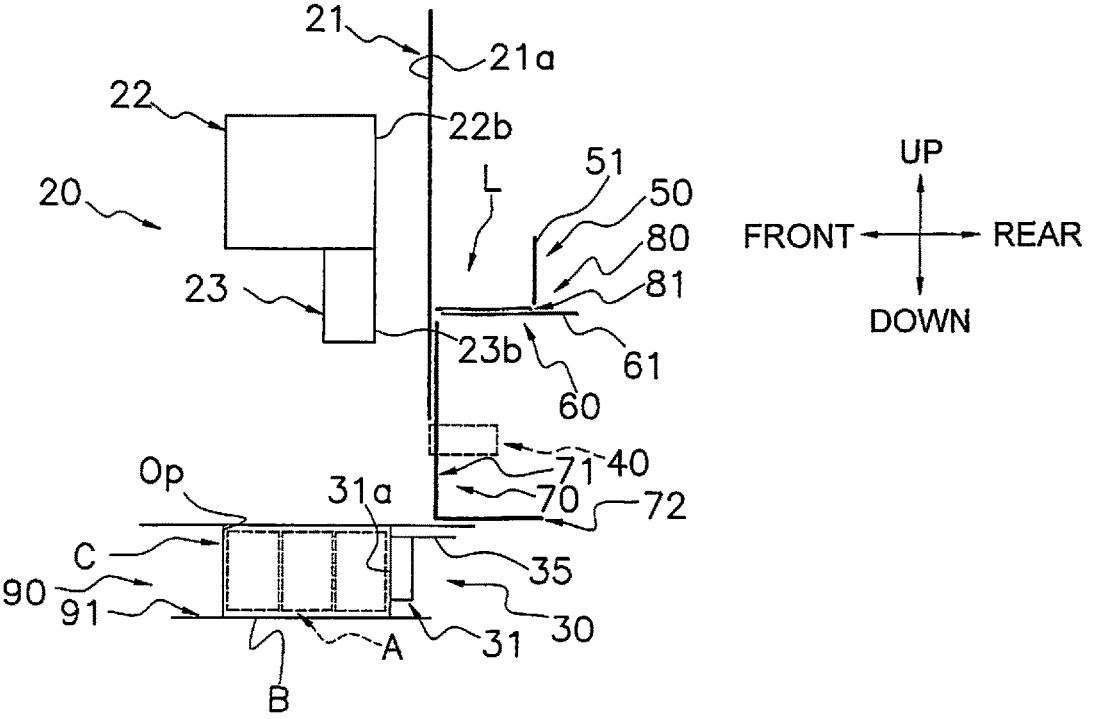
FIG. 6L is a figure depicting the operation of the box packing unit of the box packing apparatus of FIG. 1.
Figure 7:
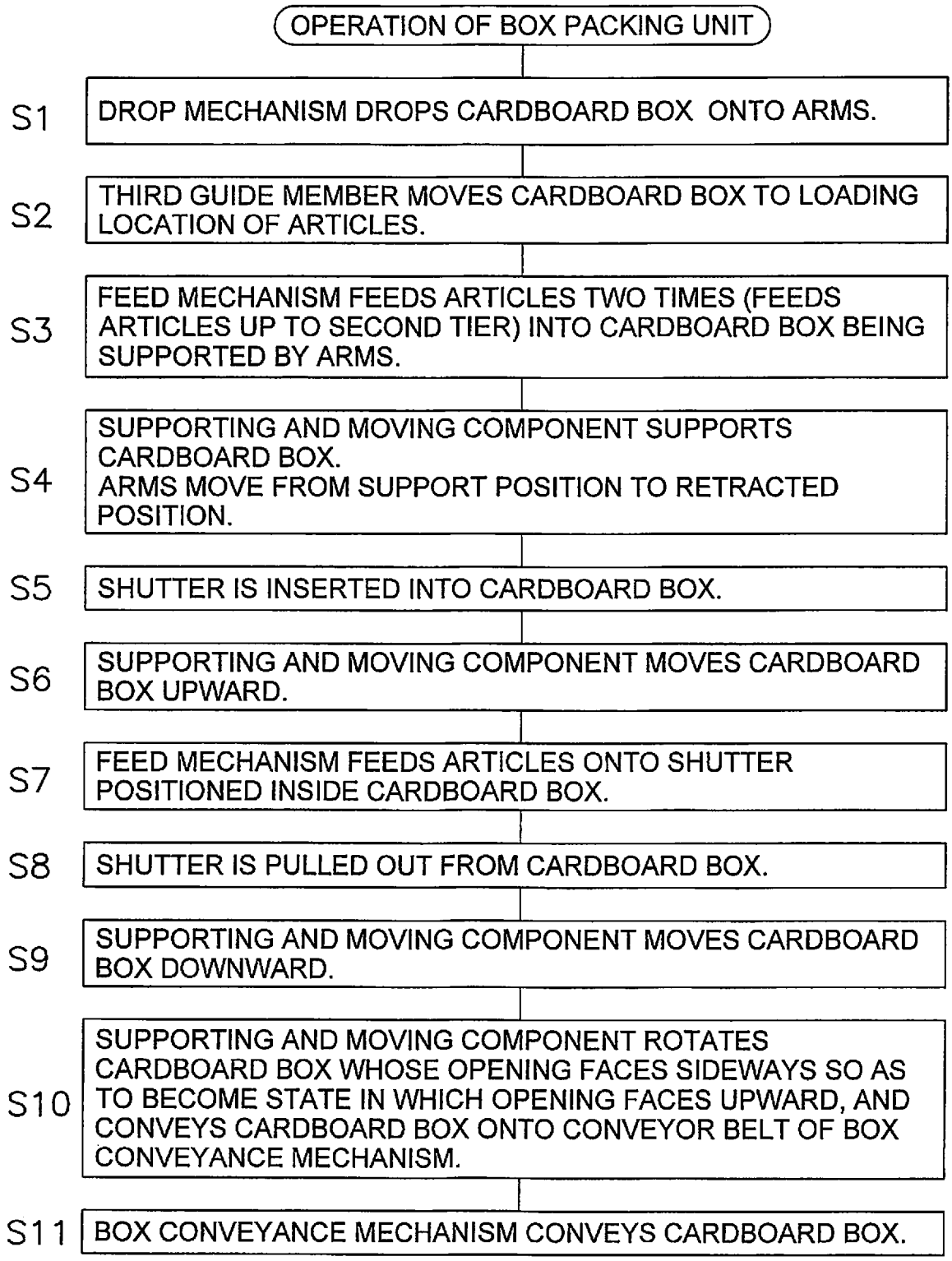
FIG. 7 is a flowchart depicting the operation of the box packing unit of the box packing apparatus of FIG. 1.

Specifically, when the arms 40 are disposed in the retracted position, the end portions on the front sides of the arms 40 are positioned further to the rear side than the guide surfaces 21*a* of the first guide members 21 of the drop mechanism 20 that guide the flaps C21 and C23 of the cardboard box C (see FIG. 6L). For that reason, the support surfaces 40*a* of the arms 40 disposed in the retracted position do not contact the flaps C21 and C23 of the cardboard box C. In contrast, the support position of the arms 40 is further to the front side than the retracted position of the arms 40, and the end portions on the front sides of the arms 40 placed in the support position are positioned further to the front side than the guide surfaces 21*a* of the first guide members 21 of the drop mechanism 20 (see FIG. 6B). That is to say, the arms 40 disposed in the support position are in positions in which the support surfaces 40*a* of the arms 40 contact the flap C21 or the flap C23 of the cardboard box C.

(2-1-4) Feed Mechanism

The feed mechanism 50 feeds the articles A through the opening Op into the cardboard box C being supported by the arms 40 and whose opening Op faces sideways. Furthermore, the feed mechanism 50 feeds the articles A through the opening Op into the cardboard box C being supported by the supporting and moving component 30 and whose opening Op faces sideways.

It will be noted that in the present embodiment the box packing apparatus 10 stacks and loads the articles A in multiple tiers inside each the cardboard box C that is in a state in which the opening Op faces sideways as a result of the feed mechanism 50 feeding the articles A multiple times into the each cardboard box C. More specifically, in the present embodiment the box packing apparatus 10 stacks and loads the articles A in three tiers inside the each cardboard box C that is in a state in which the opening Op faces sideways as a result of the feed mechanism 50 feeding the articles A three times into the each cardboard box C. That is to say, here, the feed mechanism 50 feeds the articles A initially (a first time) into a certain cardboard box C so that a first tier (a lowermost tier) of the articles A is fed into the cardboard box C being in a state in which the opening Op faces sideways. Thereafter, the feed mechanism 50 feeds the articles A for a second time into that cardboard box C so that a second tier of the articles A is fed into the cardboard box C being in a state in which the opening Op faces sideways, and then the feed mechanism 50 feeds the articles A for a third time so that a third tier (an uppermost tier) of the articles A is fed into the cardboard box C being in a state in which the opening Op faces sideway. Here, four articles A are fed at each time of the feeding operation performed by the feed mechanism 50, but the number of articles A that are fed at one time is not limited to this.

The feed mechanism 50 mainly has a push-out plate 51 and a push-out drive component 52 (see FIG. 3 and FIG. 5).

The push-out plate 51 is a tabular member disposed so as to oppose the opening Op of the cardboard box C disposed in the loading location L of the articles A (see FIG. 6C). The push-out plate 51 is driven by the push-out drive component 52 in the forward and rearward directions. The push-out drive component 52 is an air cylinder, for example.

Just before the feed mechanism 50 starts feeding the articles A, the push-out plate 51 is disposed on the rear side of the articles A that have been conveyed by the article conveyance mechanism 80 to the rear side of the opening Op of the cardboard box C (see FIG. 6C). When the feed mechanism 50 feeds the articles A into the cardboard box C, the push-out plate 51 is driven by the push-out drive component 52 to the neighborhood of the opening Op of the cardboard box C (see FIG. 6D). At this time, the push-out plate 51 comes into abutting contact with the articles A that have been placed on the conveyor belt 81 of the article conveyance mechanism 80 and feeds the articles A through the opening Op inside the cardboard box C. When the push-out plate 51 finishes feeding the articles A into the cardboard box C, the push-out plate 51 is moved by the push-out drive component 52 to the rear side of the conveyor belt 81 of the article conveyance mechanism 80. The push-out plate 51 stands by on the rear side of the conveyor belt 81 until the articles A are conveyed to the front side of the push-out plate 51 by the article conveyance mechanism 80 and it becomes time to feed the articles A.

(2-1-5) Shutter Mechanism

The shutter mechanism 60 is a member that keeps the articles A that have already been fed into the cardboard box C from hindering the feeding of the articles A when the articles A are fed into the cardboard box C.

The shutter mechanism 60 mainly has a shutter 61 and a shutter drive component 62 (see FIG. 3 and FIG. 6A).

The shutter 61 is a tabular member that is inserted through the opening Op into the cardboard box C that is in a state in which the opening Op faces sideways (rearward). The shutter 61 is a tabular member that extends in the horizontal direction. In other words, the shutter 61 is a tabular member that has a horizontal surface. The shutter 61 is driven by the shutter drive component 62 in the forward and rearward directions. The shutter 61 is disposed under the conveyor belt 81 of the article conveyance mechanism 80.

The shutter 61, as described later, stands by at further rear side than the opening Op of the cardboard box C until the articles A are fed twice into the cardboard box C by the feed mechanism 50 (see FIG. 6C). The shutter 61 is moved forward by the shutter drive component 62 and is inserted through the opening Op of the cardboard box C as far as the vicinity of the bottom B of the cardboard box C (see FIG. 6H) in a state in which a part of the articles A to be loaded have been loaded inside the cardboard box C (a state in which the articles A has been loaded to the second tier). The shutter 61 is inserted, through the opening Op of the cardboard box C into the cardboard box C supported in the loading location L of the articles A so as to cover the upper side of the articles A that have been loaded inside the cardboard box C. The supporting and moving component 30, as described later, is configured to move the cardboard box C upward in a state in which the shutter 61 is inserted into the cardboard box C. Due to this configuration, the articles A are sandwiched between the shutter 61 and the bottom surface (the side surface portion C14) of the cardboard box C being in a state in which the opening Op faces sideways, and gaps that have arisen between the articles A themselves and between the articles A and the side surface portions C11, C13, and C14 of the cardboard box C become smaller.

Furthermore, as described later, when the feed mechanism 50 feeds the articles A for the third time (for the third tier) into the cardboard box C, the feed mechanism 50 feeds the articles A inside the cardboard box C that is supported by the supporting and moving component 30 with the shutter 61 remaining inserted through the opening Op. For that reason, when the feed mechanism 50 feeds the articles A into the cardboard box C for the third time, the feed mechanism 50 feeds the articles A onto the shutter 61. The articles A are loaded inside the cardboard box C as a result of the shutter 61 being driven by the shutter drive component 62 and pulled out of the cardboard box C after the feeding of the articles A. Because the articles A are fed onto the shutter 61 and thereafter the shutter 61 is pulled out, the feeding of the articles A is not hindered by the articles A that are already inside the cardboard box C.

(2-1-6) Spill-out Prevention Mechanism

The spill-out prevention mechanism 70 is a member for preventing the articles A that have been loaded into the cardboard box C from spilling out of the cardboard box C that is in a state in which the opening Op faces sideways.

The spill-out prevention mechanism 70 mainly has a vertical plate 71 and a swinging plate 72 that extends from the lower end of the vertical plate 71 (see FIG. 6A). The vertical plate 71 is a member that extends in the vertical direction. The vertical plate 71 is an immovable member. The swinging plate 72 is a member that is swingable about a rotating shaft (not shown in the drawings) provided in the neighborhood of the lower end of the vertical plate 71 and extending in the right and left direction. The swinging plate 72 is swingable 90 degrees in a counter-clockwise direction about the rotating shaft provided in the neighborhood of the lower end of the vertical plate 71 from a state in which the swinging plate 72 extends in the vertical direction as shown in FIG. 6K to a state in which the swinging plate 72 extends in the horizontal direction as shown in FIG. 6L when seen from the right direction.

The vertical plate 71 has, on its front surface side, a first spill-out prevention surface 71*a* that opposes the opening Op of the cardboard box C supported by the supporting and moving component 30 or the arms 40 (see FIG. 6E). The swinging plate 72 being in a state which extends in the vertical direction from the vertical plate 71 has, on its front surface side, a second spilt-out prevention surface 72*a* that opposes the opening Op of the cardboard box C supported by the supporting and moving component 30 or the arms 40 (see FIG. 6E). The first spill-out prevention surface 71*a* is a flat surface that extends in the right and left direction and the up and down direction. That is to say, the first spill-out prevention surface 71*a* is a vertical surface. In a state in which the support surface 31*a* of the holding component 31 of the supporting and moving component 30 faces upward, the first spill-out prevention surface 71*a* and the second spill-out prevention surface 72*a* are disposed in the same (hypothetical) plane. That is to say, in a state in which the support surface 31*a* of the holding component 31 of the supporting and moving component 30 faces upward, the second spill-out prevention surface 72*a* is a flat surface that extends in the right and left direction and the up and down direction. The first spill-out prevention surface 71*a* and the second spill-out prevention surface 72*a* that extend in the right and left direction and the up and down direction close a part of the opening Op of the cardboard box C and prevent the articles A from spilling out of the cardboard box C when the articles A are fed into the cardboard box C and when the cardboard box C having the articles A accommodated therein is driven by the supporting and moving component 30 in the upward and downward directions.

The second spill-out prevention surface 72*a* of the swinging plate 72 is pushed in a direction (rearward) away from the cardboard box C by the push plate 35 of the holding component 31 when the rotating component 34 of the supporting and moving component 30 rotates the holding component 31 from the state in which the support surface 31*a* faces upward to the state in which the support surface 31*a* faces forward (see FIG. 6A). The second spill-out prevention surface 72*a* is not directly pushed by the push plate 35 but is pushed by the push plate 35 via the flap C24 of the cardboard box C (see FIG. 6A).

Because the swinging plate 72 is provided on the lower end of the vertical plate 71, the spill-out prevention mechanism 70 does not hinder the rotation of the holding component 31 and can prevent the articles A from spilling out through the opening Op of the cardboard box C until just before the holding component 31 is rotated (until just before the cardboard box C is rotated by the supporting and moving component 30).

(2-1-7) Article Conveyance Mechanism

The article conveyance mechanism 80 conveys the articles A to be packed in the cardboard boxes C (see FIG. 5 and FIG. 6A).

The article conveyance mechanism 80 mainly has a conveyor belt 81 and a conveyance drive component 82 that drives the conveyor belt 81 (see FIG. 3, FIG. 5, and FIG. 6A). The conveyor belt 81 is driven by the conveyance drive component 82 to convey the articles A at a predetermined speed and timing. The conveyance drive component 82 is a motor, for example. The conveyance drive component 82 drives the conveyor belt 81 in such a way that the articles A are conveyed to the front side of the push-out plate 51 of the feed mechanism 50 at a predetermined timing.

(2-1-8) Box Conveyance Mechanism

The box conveyance mechanism 90 (see FIG. 6A) conveys the cardboard boxes C that have been loaded with the articles A.

The box conveyance mechanism 90 mainly has a conveyor belt 91 and a conveyance drive component 92 that drives the conveyor belt 91 (see FIG. 3 and FIG. 6A). The conveyance drive component 92 is a motor, for example.

In the box conveyance mechanism 90, the conveyance drive component 92 drives the conveyor belt 91 to convey the cardboard box C that has been loaded with the articles A, which the supporting and moving component 30 has moved from the loading location L of the articles A onto the conveyor belt 91, and supply it to the box closing unit 3 at a predetermined speed and timing. The box conveyance mechanism 90 conveys to the box closing unit 3 the cardboard box C that is in a state in which the opening Op faces upward.

(2-2) Control Unit

The control unit 4 is electrically connected to the box forming unit 1, the box packing unit 2, and the box closing unit 3, and controls the operations of the box forming unit 1, the box packing unit 2, and the box closing unit 3. The control unit 4 controls, for example, the operations of the drop mechanism 20, the supporting and moving component 30, the arms 40 (the arm drive components 41), the feed mechanism 50, the shutter mechanism 60, the article conveyance mechanism 80, and the box conveyance mechanism 90 of the box packing unit 2.

The control unit 4 is configured by a control component 4*a*, which mainly has a central processing unit (CPU), and a storage component 4*b*, which has a read-only memory (ROM), a random access memory (RAM), and a hard disk drive (HDD).

The control component 4*a* calls up and executes various types of programs stored in the storage component 4*b* to control the operations of the various parts of the box packing unit 2 such as the drop mechanism 20, the supporting and moving component 30, the arms 40 (the arm drive components 41), the feed mechanism 50, the shutter mechanism 60, the article conveyance mechanism 80, and the box conveyance mechanism 90. Furthermore, the control component 4*a* calls up and executes various types of programs stored in the storage component 4*b* to control the various parts of the box forming unit 1 and the box closing unit 3.

(3) Operation of Box Packing Unit

The operation of the box packing unit 2 of the box packing apparatus 10 will be described with reference to FIG. 6A to FIG. 6L and FIG. 7. It will be noted that the operation of the box packing unit 2 (the operations of the various elements of the box packing unit 2) is controlled by the control unit 4 as mentioned above.

First, the states of the various elements of the box packing unit 2 at the point in time when the box packing unit 2 starts the box packing operation for a given cardboard box C (just before the drop mechanism 20 drops the cardboard box C onto the arms 40) will be described with reference to FIG. 6A.

In the drop mechanism 20, the third guide members 23 are in the first state in which they are capable of guiding the side surface portions C1 and the flaps C2 while the cardboard box C drops. Furthermore, in the drop mechanism 20, the second guide members 22 and the third guide members 23 are in the state in which they have been moved to the front side by the first drive components 24. For that reason, the guide surfaces 22*b* of the second guide members 22 and the guide surfaces 23*b* of the third guide members 23 are disposed in a state in which they are relatively spaced apart from the guide surfaces 21*a* of the first guide members 21. The supporting and moving component 30 is in a state in which it has placed a cardboard box C that has been loaded with the articles A (a cardboard box C directly preceding the cardboard box C that will drop next and into which the articles A have been loaded by the box packing unit 2) onto the conveyor belt 91 of the box conveyance mechanism 90. It will be noted that at this time it is not necessary for the supporting and moving component 30 to have already placed the cardboard box C that has been loaded with the articles A onto the conveyor belt 91 of the box conveyance mechanism 90, and that the supporting and moving component 30 may also be in the middle of moving the cardboard box C that has been loaded with the articles A from the loading location L of the articles A onto the conveyor belt 91. The arms 40 are in a state in which the arms 40 project forward beyond the guide surfaces 21*a* of the first guide members 21. That is to say, the arms 40 are in the support position in which they are capable of catching and supporting the cardboard box C that will drop. The feed mechanism 50 stands by in a state in which it is capable of feeding the articles A into the cardboard box C. In other words, the push-out plate 51 of the feed mechanism 50 is in a state in which it is disposed on the rear side of the articles A that have been conveyed thereto by the article conveyance mechanism 80. In the shutter mechanism 60, the shutter 61 is disposed further to the rear side than the guide surfaces 21*a* of the first guide members 21. In the spill-out prevention mechanism 70, the swinging plate 72 that has been pushed by the push plate 35 of the holding component 31 of the supporting and moving component 30 is in a state in which the second spill-out prevention surface 72*a* faces downward. The article conveyance mechanism 80 is in a state in which it has finished conveying the articles A to the front of the push-out plate 51 of the feed mechanism 50. The cardboard box C that has been loaded with the articles A and which the supporting and moving component 30 has moved is placed on the conveyor belt 91 of the box conveyance mechanism 90.

When the respective elements of the box packing unit 2 are in these states, in step S1, the drop mechanism 20 drops a cardboard box C onto the arms 40 (see FIG. 6B). The cardboard box C is guided by the first guide members 21, the second guide members 22, and the third guide members 23 and drops in a predetermined posture to a predetermined position on the arms 40.

Next, the first drive components 24 drive the second guide members 22 and the third guide members 23 rearward (see arrow D1 in FIG. 6B). At this time, third guide members 23 make the guide surfaces 23*b* abut against the back surfaces of the flap C21 and the flap C23 of the cardboard box C and move the cardboard box C to the loading location L of the articles A (see FIG. 6C) (step S2).

Next, in step S3, the feed mechanism 50 feeds the articles A two times through the opening Op into the cardboard box C being supported by the arms 40. Specifically, the various parts of the box packing unit 2 operate as follows, so that the feed mechanism 50 feeds the articles A two times through the opening Op into the cardboard box C being supported by the arms 40.

First, when the cardboard box C is moved to the loading location L of the articles A in step S2, the push-out drive component 52 drives the push-out plate 51 forward (see arrow D2 in FIG. 6C) to feed the first round (first tier) of the articles A into the cardboard box C being supported by the arms 40 (see FIG. 6D). Next, the push-out drive component 52 drives the push-out plate 51 rearward (the opposite direction of arrow D2 in FIG. 6C) to move the push-out plate 51 to the rear side of the conveyor belt 81 of the article conveyance mechanism 80. After the push-out plate 51 has moved to the rear side of the conveyor belt 81, or while the push-out plate 51 is moving, the conveyance drive component 82 is driven so that the articles A are conveyed by the conveyor belt 81 to the front side of the push-out plate 51 (see FIG. 6E). Then, the push-out drive component 52 again drives the push-out plate 51 in the direction of arrow D2 in FIG. 6E to feed the second round (second tier) of the articles A into the cardboard box C being supported by the arms 40 (see FIG. 6F).

Next, in step S4 the supporting and moving component 30 supports the cardboard box C that the arms 40 support in the loading location L of the articles A. When the cardboard box C that the arms 40 had been supported is supported by the supporting and moving component 30, the arms 40 move from the support position in which they support the cardboard box C to the retracted position at which they do not support the cardboard box C. This will be specifically described.

In the supporting and moving component 30, the rotating component 34 is driven to rotate the holding component 31 when the cardboard box C that has been loaded with the articles A and was moved onto the conveyor belt 91 of the box conveyance mechanism 90 is conveyed by the box conveyance mechanism 90 to a position in which the holding component 31 does not contact the cardboard box C. Specifically, the rotating component 34 rotates the holding component 31 to thereby change the posture of the holding component 31 from a state in which the support surface 31*a* of the holding component 31 faces forward (see FIG. 6D) to a state in which the support surface 31*a* of the holding component 31 faces upward (see FIG. 6E). When seen from the right side, the rotating component 34 rotates the holding component 31 in a clockwise direction (see arrow R1 in FIG. 6D). The holding component 31 of the supporting and moving component 30 stands by, in a state in which the support surface 31*a* faces upward, below the cardboard box C being supported by the arms 40 (see FIG. 6E). In step S4, the vertical drive component 33*a* is driven so that the vertical position adjusting component 33 raises the holding component 31 that is in a state in which the support surface 31*a* faces upward (see arrow D3 in FIG. 6F). Then, when the support surface 31*a* of the holding component 31 contacts the side surface portion C14 of the cardboard box C, the suction drive component 32*a* is driven so that the suckers 32 suck onto the side surface portion C14 of the cardboard box C. In this way, the holding component 31 holds the cardboard box C, and the vertical position adjusting component 33 supports the cardboard box C.

Furthermore, in step S4, when the cardboard box C is supported by the supporting and moving component 30, the arm drive components 41 are driven so that the arms 40 that had been supporting the side surface portion C14 of the cardboard box C move to the retracted position. Specifically, the arms 40 are moved in a horizontal direction (see arrow D4 in FIG. 6F) so that the end portions on the front sides of the arms 40 are disposed further to the rear side than the guide surfaces 21*a* of the first guide members 21 (see FIG. 6G).

Next, in step S5, the shutter drive component 62 of the shutter mechanism 60 is driven so that the shutter 61 is inserted through the opening Op into the cardboard box C supported by the supporting and moving component 30 (see arrow D5 in FIG. 6F). The shutter 61 covers the upper side of the two tiers' worth of the articles A that have been loaded inside the cardboard box C (see FIG. 6G).

It will be noted that the shutter 61 is here inserted into the cardboard box C after the supporting and moving component 30 supports the cardboard box C, but the timing of the insertion is not limited to this and the shutter 61 may also be inserted into the cardboard box C while the arms 40 are supporting the cardboard box C.

Next, in step S6, the vertical drive component 33*a* of the supporting and moving component 30 is driven so that the holding component 31 is raised by the vertical position adjusting component 33 (see arrow D6 in FIG. 6G). As a result, the cardboard box C that is in a state in which the shutter 61 is inserted therein through the opening Op is moved upward by the supporting and moving component 30. Because of this, the articles A inside the cardboard box C are sandwiched between the shutter 61 and the bottom surface (the side surface portion C14) of the cardboard box C that is in a state in which the opening Op faces sideways, and gaps generated between the articles A themselves and between the articles A and the side surface portions C11, C13, and C14 of the cardboard box C are decreased.

Next, in step S7, the feed mechanism 50 feeds the articles A through the opening Op into the cardboard box C being supported by the supporting and moving component 30. The feed mechanism 50 feeds the articles A onto the shutter 61 that has been inserted through the opening Op of the cardboard box C and inside the cardboard box C being supported by the supporting and moving component 30. Specifically, the each part of the box packing unit 2 operate as follows, and the feed mechanism 50 thereby feeds the articles A onto the shutter 61 positioned inside the cardboard box C being supported by the supporting and moving component 30.

After the articles A have been fed by the feed mechanism 50 two time, the push-out drive component 52 drives the push-out plate 51 rearward (the opposite direction of arrow D2 in FIG. 6E) to move the push-out plate 51 to the rear side of the conveyor belt 81 of the article conveyance mechanism 80. After the push-out plate 51 has moved to the rear side of the conveyor belt 81, or while the push-out plate 51 is moving, the conveyance drive component 82 is driven so that the articles A are conveyed by the conveyor belt 81 to the front side of the push-out plate 51 (see FIG. 6H). Then, the push-out drive component 52 drives the push-out plate 51 in the direction of arrow D2 in FIG. 6H to feed the articles A onto the shutter 61 positioned inside the cardboard box C being supported by the supporting and moving component 30 (see FIG. 6I).

Next, in step S8 the shutter drive component 62 is driven so that the shutter 61 on which the articles A are placed is pulled out through the opening Op of the cardboard box C supported by the supporting and moving component 30 (see arrow D7 in FIG. 6I). As a result, the third tier of the articles A is loaded inside the cardboard box C, and the loading of the articles A into the cardboard box C is completed (see FIG. 6J).

Next, in step S9, the vertical drive component 33*a* of the supporting and moving component 30 is driven so that the holding component 31 is lowered by the vertical position adjusting component 33 (see arrow D8 in FIG. 6J). Specifically, the vertical position adjusting component 33 lowers the holding component 31 to a position at which the rotating component 34 rotates the holding component 31. It will be noted that when the holding component 31 is lowered by the vertical position adjusting component 33, the third guide members 23 of the drop mechanism 20 are switched to the second state. That is to say, when the holding component 31 is lowered by the vertical position adjusting component 33, the third guide members 23 are driven by the second drive components 25 and moved to a position at which they do not contact the cardboard box C that the supporting and moving component 30 supports (FIG. 6K is depicted with omitting the third guide members 23 in the second state).

In step S10, the rotating component 34 of the supporting and moving component 30 rotates the holding component 31. Specifically, the rotating component 34 rotates the holding component 31 to change the posture of the holding component 31 from a state in which the support surface 31*a* of the holding component 31 faces upward to a state in which the support surface 31*a* of the holding component 31 faces forward. When the box packing apparatus 10 is seen from the right side, the rotating component 34 rotates the holding component 31 counter-clockwise (see arrow R2 in FIG. 6K). As a result, the bottom B of the cardboard box C faces downward, and the cardboard box C whose bottom B faces downward is placed on the conveyor belt 91 of the box conveyance mechanism 90 (see FIG. 6L). It will be noted that when the holding component 31 is rotated by the rotating component 34, the push plate 35 of the holding component 31 pushes the swinging plate 72 of the spill-out prevention mechanism 70, so that the swinging plate 72 goes from a state in which it extends downward from the lower end of the vertical plate 71 to a state in which it extends rearward when the box packing apparatus 10 is seen from the right side (see FIG. 6K and FIG. 6L).

It will be noted that after the implementation of step S10, the second guide members 22 and the third guide members 23 of the drop mechanism 20 are moved forward by the first drive components 24 as indicated by arrow D9 in FIG. 6K in preparation for the drop of the next cardboard box C (see FIG. 6L). Furthermore, the third guide members 23 that are in the second state are driven by the second drive components 25 and switched to the first state in which they are capable of guiding the side surface portions C1 and the flaps C2 of the cardboard box C (see FIG. 6L).

In step S11, the driving of the suction drive component 32*a* of the supporting and moving component 30 is stopped and the suckers 32 move away from the side surface portion C14 of the cardboard box C positioned on the conveyor belt 91. That is to say, the cardboard box C that has been loaded with the articles A and is positioned on the conveyor belt 91 is no longer held by the holding component 31 of the supporting and moving component 30. Thereafter, the conveyance drive component 92 of the box conveyance mechanism 90 is driven so that the cardboard box C that has been loaded with the articles A and is placed on the conveyor belt 91 is conveyed to the box closing unit 3.

The series of operations from step S1 to step S11 performed by the box packing unit 2 does not wait for the completion of all operations in regard to one cardboard box C before operations are started in regard to the next cardboard box C. Here, when preparations are completed for the drop mechanism 20 to drop a cardboard box C after the implementation of step S10, the series of operations is started in regard to the next cardboard box C without waiting for the end of step S11. It will be noted that, in the present embodiment, the series of operations is started in regard to the next cardboard box C after the implementation of step S10, but the timing is not limited to this. The series of operations may also be started in regard to the next cardboard box C after step S9 ends and before step S10 begins, or in the middle of step S10, if the drop of the cardboard box C will not be obstructed by the cardboard box C that the supporting and moving component 30 supports.

It will be noted that the operations of the box packing unit 2 that are depicted in FIG. 6A to FIG. 6L and the operations of the box packing unit 2 that have been described here are an example and are not limited to this.

(4) Characteristics (4-1)

The box packing apparatus 10 pertaining to the present embodiment feeds and loads a plurality of the articles A to be packed into each of cardboard boxes C, delivered one after another to a loading location L of articles A, through the opening Op of the cardboard box C. The cardboard boxes C are an example of boxes. The box packing apparatus 10 is equipped with the supporting and moving component 30 serving as an example of a first support component, arms 40 serving as an example of a second support component, and a feed mechanism 50. The supporting and moving component 30 supports the cardboard boxes C in the loading location L of the articles A to be packed in a state in which the opening Op thereof faces sideways and moves the cardboard boxes C that has been loaded with the articles A from the loading location L of the articles A. The arms 40 temporarily support the cardboard box C that is delivered to the loading location L of the articles A in a state in which the opening Op thereof faces sideways when the moving and supporting component 30 moves the cardboard boxes C that has been loaded with the articles A. The feed mechanism 50 feeds the articles A into the cardboard box C being supported by the arms 40 through the openings Op.

Here, while the supporting and moving component 30 is moving a cardboard box C that has been loaded with the articles A from the loading location L, the next cardboard box C (the cardboard box C that is delivered to the loading location L of the articles A following the cardboard box C that the supporting and moving component 30 is moving from the loading location L) is supported by the arms 40 in the loading location L of the articles A, and the articles A are fed into the cardboard box C being supported by the arms 40. For this reason, the box packing apparatus 10 with high processing efficiency can be realized.

(4-2)

In the box packing apparatus 10 pertaining to the present embodiment, the supporting and moving component 30 is configured to support the cardboard boxes C that the arms 40 support in the loading location L of the articles A after the supporting and moving component 30 has moved the cardboard boxes C loaded with the articles A from the loading location L of the articles A. The arms 40 move from the support position in which the arms 40 support the cardboard boxes C to the retracted position in which the arms 40 do not support the cardboard boxes C when the cardboard boxes C that the arms 40 have been supported is supported by the supporting and moving component 30.

Here, when the supporting and moving component 30 finishes moving the cardboard box C that has been loaded with the articles A, the supporting and moving component 30 supports, in succession to the arms 40, the cardboard box C that the arms 40 has supported. Therefore, the number of mechanism that moves the cardboard box C from the loading location L of the articles A may be one. For that reason, it is possible to realize the box packing apparatus 10 with high processing efficiency that can feed the articles A into the next cardboard box C while moving the cardboard box C that has been loaded with the articles A while suppressing the increment of manufacturing cost of the apparatus and increment of the size of the apparatus.

(4-3)

In the box packing apparatus 10 pertaining to the present embodiment, the arms 40 horizontally move between the support position and the retracted position.

Here, a state in which the arms 40 support the cardboard box C and a state in which the arms 40 do not support the cardboard box C can be switched by horizontally moving the arms 40. Therefore, the arms 40 can be realized with a relatively simple mechanism.

(4-4)

In the box packing apparatus 10 pertaining to the present embodiment, the box packing apparatus 10 stacks and loads the articles A in multiple tiers inside the cardboard box C being in a state in which the opening Op faces sideways as a result of the feed mechanism 50 feeding the articles A multiple times into each of the individual cardboard boxes C. The feed mechanism 50 also feeds the articles A through the opening Op into the cardboard box C being supported by the supporting and moving component 30. The supporting and moving component 30 moves the cardboard box C which the supporting and moving component 30 supports in vertical direction so that the position of the cardboard boxes C changes relative to the height at which the feed mechanism 50 feeds the articles A.

Here, in the box packing apparatus that stacks and loads the articles A in multiple tiers inside the cardboard box C being in a state in which the openings Op faces sideways, the position of the cardboard box C is changed by the supporting and moving component 30 in vertical direction relative to the feeding height of the articles A. Due to this configuration, when the articles A are stacked and loaded in multiple tiers, the articles A can be orderly loaded inside the cardboard boxes C, and the loading rate (the ratio of the volume that the articles A occupy relative to the volume of the cardboard boxes C) can be raised.

(4-5)

In the box packing apparatus 10 pertaining to the present embodiment, the box packing apparatus 10 stacks and loads the articles A in three tiers inside the cardboard box C being in a state in which the openings Op faces sideways. The arms 40 support the cardboard boxes C until the feed mechanism 50 finishes feeding the second tier of the articles A inside the cardboard boxes C.

Here, as the arms 40 support the cardboard boxes C until the second tier of the articles A is fed into the cardboard boxes C, it is easy to ensure a relatively long amount of time until the supporting and moving component 30 moves the cardboard box C that has been loaded with the articles A and then supports the next cardboard box C.

(4-6)

The box packing apparatus 10 pertaining to the present embodiment includes a tabular shutter 61 that extends in a horizontal direction. The shutter 61 is inserted through the opening Op into the cardboard box C, that is supported by the supporting and moving component 30 and inside of which a part of the articles A expected to be loaded have been loaded, and covers an upper side of the articles A that have been loaded inside the cardboard boxes C. The supporting and moving component 30 moves the cardboard boxes C upward in a state in which the shutter 61 is inserted through the opening Op.

Here, the cardboard box C is moved upward by the supporting and moving component 30 in a state in which the articles A inside the cardboard boxes C are covered by the shutter 61. Due to this configuration, the articles A can be sandwiched between the shutter 61 and the lower surface (the side surface portions C14) of the cardboard box C (of the cardboard box C that is in a state in which the opening Op faces sideways) to thereby reduce gaps that arise between the articles A themselves or between the articles A and the cardboard box C. As a result, the articles A can be orderly loaded into the cardboard box C to thereby raise the loading rate of the cardboard box C.

(4-7)

In the box packing apparatus 10 pertaining to the present embodiment, the feed mechanism 50 feeds the articles A onto the shutter 61 that is inserted through the openings Op into the cardboard box C that is supported by the supporting and moving component 30. The articles A are loaded inside the cardboard box C as a result of the shutter 61 being pulled out after the feeding of the articles A.

Here, as the shutter 61 is used when feeding the articles A, the articles A can be fed into the cardboard box C without being hindered by the articles A that have already been loaded inside the cardboard box C, and the occurrence of problems such as the articles A not being put into the cardboard boxes C can be prevented.

(5) Modifications

Example modifications of the embodiment will be described below. The plural modifications may also be appropriately combined to the extent that they do not contradict each other.

(5-1) Modification A

In the above embodiment, the box packing apparatus 10 is equipped with the box forming unit 1 and the box closing unit 3 in addition to the box packing unit 2, but the box packing apparatus 10 is not limited to this. The box packing apparatus 10 may not have the box forming unit 1 and/or the box closing unit 3.

(5-2) Modification B

In the above embodiment, the box packing apparatus 10 stacks and loads the articles A in three tiers into the each cardboard box C that is in a state in which the opening Op faces sideways, but the box packing apparatus 10 is not limited to this.

For example, the box packing apparatus 10 may also stack and load the articles A in four or more tiers into the each cardboard box C that is in a state in which the openings Op faces sideways.

In this case, for example, the arms 40 support the cardboard box C until the feed mechanism 50 finishes feeding the second tier of the articles A inside the cardboard box C, and thereafter the supporting and moving component 30 supports the cardboard box C in the loading location L of the articles A. When the feed mechanism 50 feeds the third and subsequent tiers of the articles A inside the cardboard box C, it is preferred that the supporting and moving component 30 adjust the height position of the cardboard box C each time so that the position of the cardboard box C changes relative to the height at which the articles A are fed by the feed mechanism 50. Furthermore, when the feed mechanism 50 feeds the third and subsequent tiers of the articles A inside the cardboard box C, it is preferred that step S5 to step S8 of the flowchart in FIG. 7 be executed each time.

Furthermore, the arms 40 may also be configured to support the cardboard box C until the feed mechanism 50 finishes feeding the third and subsequent tiers of the articles A inside the cardboard box C. However, in order to raise the loading rate of the cardboard box C, it is preferred that, before the feed mechanism 50 feeds the third and subsequent tiers of the articles A inside the cardboard box C, the supporting and moving component 30 supports the cardboard box C and moves the cardboard box C upward in a state in which the shutter 61 is inserted into the cardboard box C.

(5-3) Modification C

In the above embodiment, the feed mechanism 50 feeds the articles A also to the cardboard box C that the supporting and moving component 30 supports, but the box packing apparatus 10 is not limited to this. The box packing apparatus 10 may also be configured in such a way that the arms 40 hold the cardboard box C until all the articles A are fed and thereafter the first support component holds the cardboard box C.

However, in the case of stacking and loading the articles A in multiple tiers into the cardboard boxes C that are in a state in which the openings Op faces sideways, in order to prevent the occurrence of problems such as the articles A not fitting well in the openings Op, the loading rate of the cardboard box C being lowered, and the like, it is preferred that the box packing apparatus 10 be configured in such a way that the cardboard boxes C are supported, from the middle, by the supporting and moving component 30 that can change the position of the cardboard box C relative to the height at which the articles A are fed by the feed mechanism 50 and the feed mechanism 50 feeds the articles A to the cardboard boxes C being supported by the supporting and moving component 30.

(5-4) Modification D

In the above embodiment, the arms 40 horizontally move between the support position and the retracted position, but the arms 40 are not limited to this. For example, the arms 40 may also be configured to vertically move between the support position and the retracted position. Furthermore, the arms 40 may also be configured to move between the support position and the retracted position as a result of being rotated about predetermined shafts.

(5-5) Modification E

In the above embodiment, the supporting and moving component 30 moves the cardboard box C from the loading location L of the articles A by moving the cardboard box C downward and further rotating the cardboard box C so that the direction the opening Op faces changes, but the supporting and moving component 30 is not limited to this. For example, the supporting and moving component 30 may move the cardboard box C from the loading location L of the articles A by moving the cardboard box C in a horizontal direction. Furthermore, the supporting and moving component 30 may also move the cardboard box C from the loading location L of the articles A by just rotating the cardboard box C (by just rotating the holding component 31 with the rotating component 34) so that the direction the opening Op faces changes, without moving the cardboard boxes C downward.

(5-6) Modification F

In the above embodiment, the arms 40 support the cardboard boxes C until the feed mechanism 50 finishes feeding the second tier of the articles A inside the each cardboard box C, but the arms 40 are not limited to this. The arms 40 may support the cardboard boxes C until the feed mechanism 50 finishes feeding the first tier of the articles A inside the each cardboard box C.

(5-7) Modification G

Figure 8A:
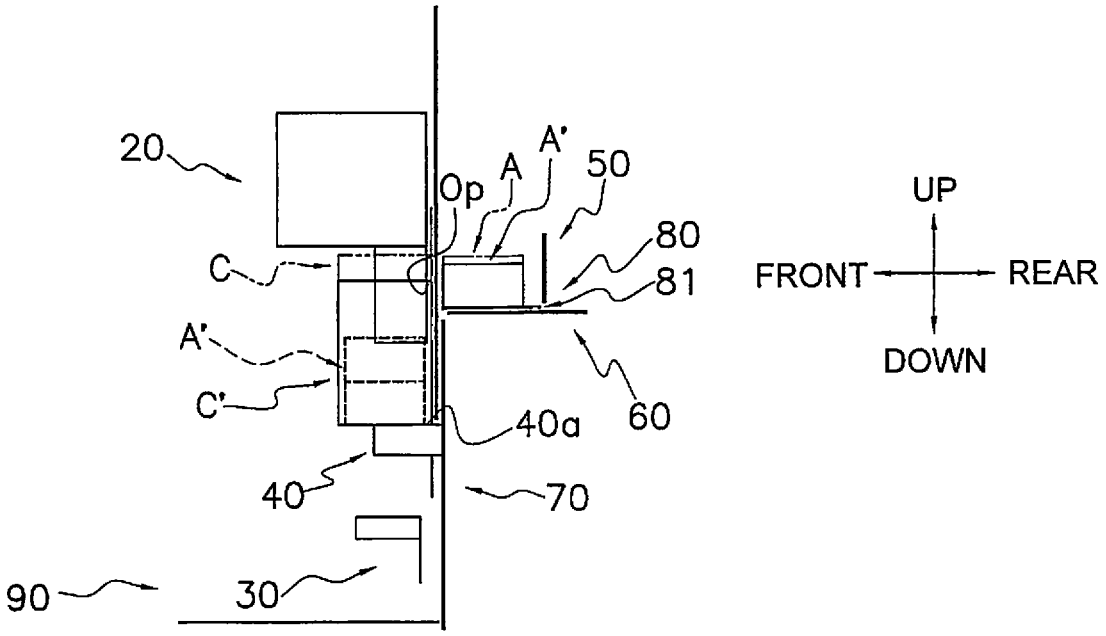
FIG. 8A is a figure depicting the feeding of articles into the cardboard box in a case where the height position at which the arms support the cardboard box cannot be adjusted in the box packing unit of the box packing apparatus of FIG. 1.
Figure 8B:
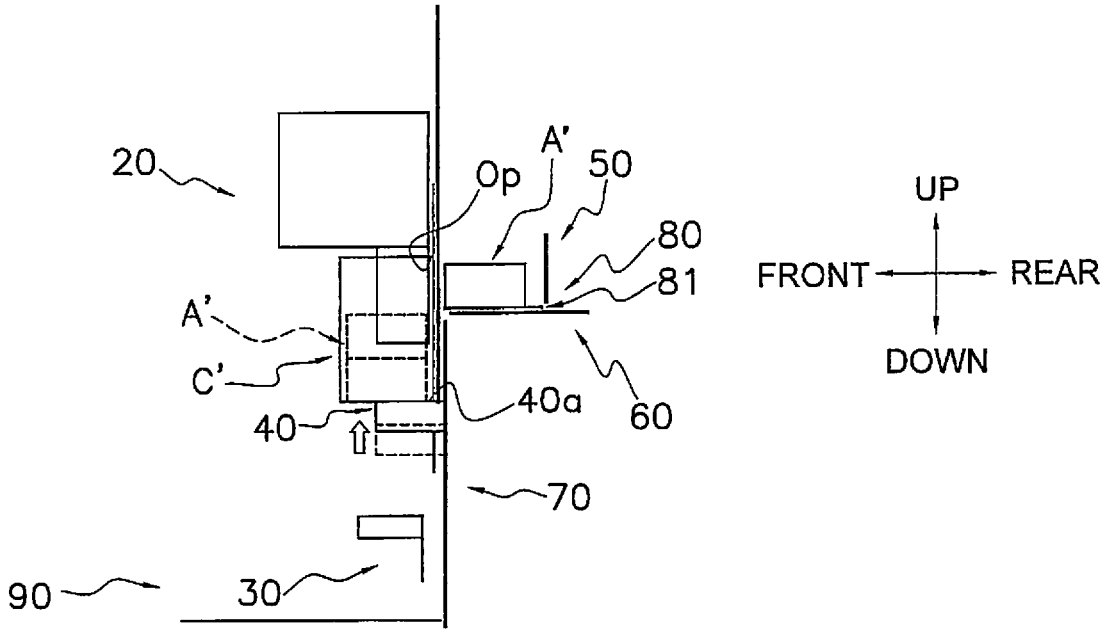
FIG. 8B is a figure depicting the feeding of articles into the cardboard box in a case where the height position at which the arms support the cardboard box is adjustable in the box packing unit of the box packing apparatus of FIG. 1 (modification G).

In the box packing apparatus 10 of the embodiment, it is preferred that the arms 40 be configured in such a way that the height position at which they support the boxes is adjustable. This will be described below with reference to FIG. 8A and FIG. 8B.

For example, a case is supposed where, in addition to the cardboard box C, a cardboard box C' (see FIG. 8A) whose height in a state in which the opening Op faces sideways is lower than that of the cardboard box C is used in the box packing apparatus 10. Furthermore, a case is supposed where articles A' (see FIG. 8A), whose thickness in their height direction in a posture when fed by the feed mechanism 50 is thinner than that of the articles A in the above embodiment, are stacked and loaded in three tiers inside the cardboard box C' that is in a state in which the opening Op faces sideways. And, a case is supposed where the articles A' are fed up to the second tier into the cardboard box C' in a state in which the cardboard box C' is supported by the arms 40 as in the above embodiment.

At this time, unless the height position at which the arms 40 support the box can be adjusted, the position of the upper end of the opening Op of the cardboard box C' (the position of the upper surface of the cardboard box C' that is in a state in which the opening Op faces sideways) becomes lower than the position of the upper ends of the articles A' on the conveyor belt 81 of the article conveyance mechanism 80 and there is a possibility that the articles A' cannot be fed by the feed mechanism 50 into the cardboard box C'. Furthermore, even if it is possible to feed the articles A' into the cardboard box C', the height difference between the conveyance surface of the conveyor belt 81 and the bottom surface of the cardboard box C' that is in a state in which the opening Op faces sideways becomes greater compared to the thickness of the two tiers' worth of the articles A' (see FIG. 8A), and when, for example, the second tier of the articles A' is fed, a situation can arise where the articles A' cannot be orderly fed into the cardboard box C', such as, for example, a situation where some of the articles A' that have been fed ride up on the articles A' that were fed at the same time.

In contrast, by making the height position at which the arms 40 support the box adjustable and, for example, disposing the cardboard box C' that is in a state in which the opening Op faces sideways so that the articles A' can be fed through the opening Op into the cardboard box C' and so that the height difference between the bottom surface of the cardboard box C' and the conveyance surface of the conveyor belt 81 generally correspond with the thickness of two tiers' worth of the articles A' (see FIG. 8B), it becomes possible to prevent feeding errors of the article A' and to orderly load the articles A' into the cardboard box C'.

When the arms 40 are configured in such a way that the height position at which the arms 40 support the box is adjustable, the arms 40 and the arm drive components 41 that drive the arms 40 may be configured in such a way that the position is adjusted in the vertical direction using a ball screw mechanism and a motor, for example.

INDUSTRIAL APPLICABILITY

The box packing apparatus pertaining to the present invention is useful as a box packing apparatus with high processing efficiency.

The invention claimed is:

1. A box packing apparatus configured to feed and load a plurality of the articles to be packed into boxes one after another to a loading location, the box packing apparatus comprising:

a first support component configured to support a first box in the loading location with an opening of the first box facing sideways and further configured to move the first box after loading of the articles from the loading location;

a second support component configured to temporarily support a second box that is delivered to the loading location in a state in which the opening faces sideways when the first support component moves the first box away from the loading location after being loaded with the articles, the first support component being further configured to return to the loading location and support the second box, the second support component being separate from the first support component; and a feed mechanism configured to feed the articles to be packed into the box being supported at least by the second support component through the opening.

2. The box packing apparatus according to claim 1, wherein the first support component is configured to support the box that the second support component supports in the loading location after the first support component has moved the box that has been loaded with the articles from the loading location, and the second support component is configured to move from a support position in which the second support component supports the box to a retracted position in which the second support component does not support the box when the box that the second support component has been supported is supported by the first support component.

3. The box packing apparatus according to claim 2, wherein the second support component is configured to horizontally move between the support position and the retracted position.

4. The box packing apparatus according to claim 1, wherein the second support component is configured in such a way that a height position at which the second support component supports the box is adjustable.

5. The box packing apparatus according to claim 1, wherein the box packing apparatus is configured to stack and load the articles to be packed in multiple tiers inside the box being in a state in which the opening faces sideways as a result of the feed mechanism feeding the articles to be packed multiple times into the box, the feed mechanism is configured to feed the articles to be packed through the opening into the box being supported by the first support component, and the first support component is configured to move the box which the first support component supports in a vertical direction so that the position of the box changes relative to a height at which the feed mechanism feeds the articles to be packed.

6. The box packing apparatus according to claim 5, wherein the box packing apparatus is configured to stack and load the articles to be packed in three or more tiers inside the box being in a state in which the opening faces sideways, and the second support component is configured to support the box until the feed mechanism finishes feeding the second tier of the articles to be packed inside the box.

7. The box packing apparatus according to claim 6, further comprising a tabular shutter extending in a horizontal direction and configured to be inserted through the opening into the box that is supported by the first support component and inside of which a portion of the articles to be packed expected to be loaded have been loaded, and cover an upper side of the articles that have been loaded inside the box, wherein the first support component is configured to move the box upward in a state in which the shutter is inserted through the opening.

8. The box packing apparatus according to claim 7, wherein the feed mechanism is configured to feed the articles to be packed onto the shutter that is inserted through the opening into the box that is supported by the first support component, and the articles to be packed are loaded inside the box as a result of the shutter being pulled out after the feeding of the articles.

9. The box packing apparatus according to claim 2, wherein the second support component is configured in such a way that a height position at which the second support component supports the box is adjustable.

10. The box packing apparatus according to claim 2, wherein the box packing apparatus is configured to stack and load the articles to be packed in multiple tiers inside the box being in a state in which the opening faces sideways as a result of the feed mechanism feeding the articles to be packed multiple times into the box, the feed mechanism is configured to feed the articles to be packed through the opening into the box being supported by the first support component, and the first support component is configured to move the box which the first support component supports in a vertical direction so that the position of the box changes relative to a height at which the feed mechanism feeds the articles to be packed.

* * * * *